US008387953B2

(12) United States Patent
Drake

(10) Patent No.: US 8,387,953 B2
(45) Date of Patent: Mar. 5, 2013

(54) APPARATUSES AND METHODS FOR AN IMPROVED VEHICLE JACK HAVING A SCREW JACK ASSEMBLY

(75) Inventor: Daniel Vernon Drake, Wichita, KS (US)

(73) Assignee: MoJack Distributors, LLC, Wichita, KS (US)

( * ) Notice: Subject to any disclaimer, the term of this patent is extended or adjusted under 35 U.S.C. 154(b) by 529 days.

(21) Appl. No.: 12/707,999

(22) Filed: Feb. 18, 2010

(65) Prior Publication Data

US 2010/0283016 A1 Nov. 11, 2010

Related U.S. Application Data

(60) Provisional application No. 61/175,652, filed on May 5, 2009.

(51) Int. Cl.
*B66F 7/12* (2006.01)
*B66F 7/14* (2006.01)

(52) U.S. Cl. ..... 254/112; 254/108; 254/4 C; 254/4 B; 254/105; 187/210; 187/208

(58) Field of Classification Search ..... 254/4 C, 254/4 B, 4 R, 6 C, 6 B, 12, 112, 108, 105; 187/210, 208, 207, 216
See application file for complete search history.

(56) References Cited

U.S. PATENT DOCUMENTS

| | | | | |
|---|---|---|---|---|
| 652,836 A | | 7/1900 | Covert | |
| 854,961 A | * | 5/1907 | McCarthy | 414/633 |
| 959,274 A | * | 5/1910 | Voll et al. | 254/4 R |
| 1,307,080 A | * | 6/1919 | Chumbley | 254/6 B |
| 1,353,564 A | * | 9/1920 | Chesnutt | 254/5 C |
| 1,528,749 A | * | 3/1925 | Barrett | 254/4 C |
| 1,554,120 A | | 9/1925 | Mosher | |
| 1,920,350 A | | 8/1933 | Bourdon | |
| 2,278,817 A | * | 4/1942 | Zeindler | 254/4 R |
| 2,551,483 A | | 5/1951 | Bartoe | |
| 2,640,615 A | | 6/1953 | Wedel | |

(Continued)

FOREIGN PATENT DOCUMENTS

| | | |
|---|---|---|
| CH | 526 463 A | 8/1972 |
| FR | 2 781 779 | 2/2000 |

(Continued)

OTHER PUBLICATIONS

International Written Opinion dated May 16, 2011, PCT Application No. PCT/US2010/024902, filed Feb. 22, 2010.

(Continued)

*Primary Examiner* — Phi Dieu Tran A
(74) *Attorney, Agent, or Firm* — Spencer Fane Britt & Browne LLP

(57) ABSTRACT

Various embodiments of a vehicle jack an include an elevation assembly and a guide bracket. The elevation assembly includes a threaded member and an elongated support member, with the elongated support member configured to threadedly engage and rotate relative to the threaded member. The guide assembly includes a guide bracket configured to engage the threaded member such that the threaded member moves with the guide assembly as the guide assembly moves along a path defined by a longitudinal axis of the elongated support member. This movement raises or lowers a vehicle positioned on the jack. Various embodiments address the assembly of a vehicle jack by engaging a threaded member with an elongated support member and a guide bracket. Rotation of the elongated support member about its longitudinal axis causes the threaded member to move the guide bracket along a path defined by the longitudinal axis.

16 Claims, 18 Drawing Sheets

U.S. PATENT DOCUMENTS

| | | | | |
|---|---|---|---|---|
| 2,857,985 | A | 10/1958 | Simmons, Sr. | |
| 2,867,409 | A | 1/1959 | Southerwick | |
| 2,947,513 | A | 8/1960 | Nolden | |
| 2,992,811 | A | 7/1961 | Turner | |
| 3,038,700 | A | 6/1962 | Ascherl | |
| 3,185,318 | A * | 5/1965 | Lewis, Sr. | 414/590 |
| 3,215,402 | A | 11/1965 | Hott | |
| 3,225,868 | A | 12/1965 | Barnes | |
| 3,306,579 | A | 2/1967 | Campbell | |
| 3,378,154 | A | 4/1968 | Mousel | |
| 3,924,763 | A | 12/1975 | Pigeon | |
| 4,030,697 | A | 6/1977 | Robinson | |
| 4,066,243 | A | 1/1978 | Johnson | |
| 4,123,038 | A | 10/1978 | Meyrs | |
| 4,421,209 | A | 12/1983 | Vermette | |
| 4,427,094 | A | 1/1984 | Winkelblech | |
| 4,473,237 | A | 9/1984 | Lind | |
| 4,549,721 | A | 10/1985 | Stone | |
| 4,564,207 | A | 1/1986 | Russ | |
| 4,632,627 | A | 12/1986 | Swallows | |
| 4,645,181 | A | 2/1987 | Schapansky | |
| 4,674,943 | A | 6/1987 | Newpor | |
| 4,984,657 | A | 1/1991 | Burns | |
| 5,000,423 | A | 3/1991 | Snickers | |
| 5,123,802 | A | 6/1992 | Bell | |
| 5,174,414 | A | 12/1992 | Burns | |
| 5,176,487 | A | 1/1993 | Flitton | |
| 5,249,777 | A | 10/1993 | Herving | |
| 5,326,216 | A | 7/1994 | Russ | |
| 5,352,083 | A | 10/1994 | Roberts | |
| 5,358,217 | A | 10/1994 | Dach | |
| 5,366,338 | A | 11/1994 | Mortensen | |
| 5,632,475 | A | 5/1997 | McCanse | |
| 5,711,512 | A | 1/1998 | Kauffman | |
| 5,984,616 | A | 11/1999 | Youmans | |
| 6,330,997 | B2 | 12/2001 | McGlaun | |
| 6,439,346 | B1 | 8/2002 | Gradziuk | |
| 6,474,626 | B1 | 11/2002 | Box | |
| D468,512 | S | 1/2003 | Hernandez | |
| 6,516,597 | B1 | 2/2003 | Samejima et al. | |
| 6,601,825 | B2 | 8/2003 | Bressner et al. | |
| 6,769,668 | B2 | 8/2004 | Siglock | |
| 6,921,095 | B2 | 7/2005 | Middleby | |
| 7,111,444 | B1 | 9/2006 | Morris | |
| 7,740,439 | B1 | 6/2010 | Browning | |
| 7,823,694 | B2 | 11/2010 | Motes | |
| 8,141,850 | B2 | 3/2012 | Drake | |
| 2004/0076501 | A1 | 4/2004 | McGill | |
| 2005/0253122 | A1 | 11/2005 | Jones | |
| 2006/0045710 | A1 | 3/2006 | Hiebert | |
| 2006/0151247 | A1 | 7/2006 | Raffler | |
| 2006/0278855 | A1 | 12/2006 | Krus | |
| 2006/0278856 | A1 | 12/2006 | Krug | |
| 2009/0134374 | A1 | 5/2009 | Krug | |
| 2010/0102284 | A1 | 4/2010 | Drake | |
| 2011/0253995 | A1 | 10/2011 | Kato | |
| 2012/0032124 | A1 * | 2/2012 | Drake | 254/105 |
| 2012/0112143 | A1 | 5/2012 | Gann | |

FOREIGN PATENT DOCUMENTS

| | | | |
|---|---|---|---|
| GB | 885 599 | A | 12/1961 |
| JP | 62 108396 | U | 7/1987 |
| JP | 63 021695 | U | 2/1988 |
| JP | 2005 145571 | A | 6/2005 |
| WO | WO 96/26886 | A1 | 9/1996 |
| WO | WO 99/11556 | A1 | 3/1999 |
| WO | WO 2010/047897 | A1 | 4/2010 |

OTHER PUBLICATIONS

Office Action mailed Feb. 28, 2007 in connection with related U.S. Appl. No. 11/147,571, filed Jun. 8, 2005.

Office Communication mailed Aug. 28, 2007 in connection with related U.S. Appl. No. 11/147,571, filed Jun. 8, 2005.

Office Action mailed May 9, 2008 in connection with related U.S. Appl. No. 11/147,571, filed Jun. 8, 2005.

Office Communication mailed Jul. 30, 2008 in connection with related U.S. Appl. No. 11/147,571, filed Jun. 8, 2005.

Notice of Allowance mailed Jun. 24, 2010 in connection with related U.S. Appl. No. 11/147,571, filed Jun. 8, 2005.

International Search Report of corresponding international application PCT/US2009/057092, dated Dec. 15, 2009.

Written Opinion of corresponding international application PCT/US2009/057092, dated Dec. 15, 2009.

International Search Report of corresponding international application PCT/US2010/024902, dated Jun. 9, 2010.

Written Opinion of corresponding international application PCT/US2010/024902, dated Jun. 9, 2010.

Office Communication mailed Jul. 18, 2008 in connection with related U.S. Appl. No. 11/327,264, filed Jan. 7, 2006 (abandoned).

Office Action mailed Apr. 8, 2008 in connection with related U.S. Appl. No. 11/327,264, filed Jan. 7, 2006 (abandoned).

Office Action mailed Feb. 8, 2008 in connection with related U.S. Appl. No. 11/327,264, filed Jan. 7, 2006 (abandoned).

International Written Opinion dated May 16, 2011, PCT/US2010/024902, filed Feb. 22, 2010.

OA mailed Feb. 8, 2008 in corres U.S. Appl. No. 11/327,264, filed Jan. 7, 2006.

Notice of Allowance mailed Nov. 28, 2011 in corres U.S. Appl. No. 12/477,563, filed Jun. 3, 2009.

OA mailed Jul. 12, 2011 in corres U.S. Appl. No. 12/477,563, filed Jun. 3, 2009.

OA mailed Dec. 17, 2011 in U.S. Appl. No. 13/275,234, filed Oct. 17, 2011.

OA mailed Jun. 6, 2012 in U.S. Appl. No. 13/275,234, filed Oct. 17, 2011.

* cited by examiner

APPARATUSES AND METHODS FOR AN IMPROVED VEHICLE JACK HAVING A SCREW JACK ASSEMBLY

CROSS-REFERENCE TO RELATED APPLICATIONS

This application claims priority from U.S. Provisional Application No. 61/175,652 entitled "Apparatuses and Methods for an Improved Vehicle Jack having a Screw Jack Assembly," filed May 5, 2009, which is herein incorporated by reference in its entirety.

BACKGROUND OF THE INVENTION

Numerous conventional jacks exist to address the need of raising vehicles (e.g., riding lawnmowers, all-terrain vehicles (ATV), etc.) smaller than typical automobiles for the purposes of performing unexpected repairs and routine maintenance.

Applicant has identified a number of deficiencies and problems associated with the manufacture, use, and maintenance of conventional jacks. Through applied effort, ingenuity, and innovation, Applicant has solved many of these problems by developing a solution that is embodied by the present invention, as described in detail below.

BRIEF SUMMARY OF THE INVENTION

Various embodiments of the invention are directed to a vehicle jack that includes a base, an upright support assembly, a guide assembly, a lifting frame assembly, an elevation assembly, and a guide bracket. The upright support assembly has a first end and a second end, and the first end is mounted adjacent and extends upwardly from the base. The guide assembly is configured to move along a path defined by the upright support assembly. The lifting frame assembly includes a vehicle part engaging portion and a connecting member configured to attach the lifting frame assembly to the guide assembly. The connecting member is configured to attach the lifting frame assembly to the guide assembly such that movement of the guide assembly along the path translates into movement of the lifting frame assembly along the path. The elevation assembly includes a threaded member and an elongated support member, with the elongated support member having a first end and a second end. The first and second ends of the elongated support member are mounted adjacent the respective first and second ends of the upright support assembly. The elongated support member is further configured to threadedly engage and rotate relative to the threaded member. The guide bracket is mounted adjacent the guide assembly and is configured to engage the threaded member such that the threaded member moves with the guide assembly as the guide assembly moves along the path defined by the upright support assembly.

In addition, various embodiments of the invention are directed to a vehicle jack that includes an elevation assembly and a guide assembly. The elevation assembly includes a threaded member and an elongated support member. The elongated support member is configured to threadedly engage and rotate relative to the threaded member. The guide assembly includes a guide bracket that is configured to engage the threaded member such that the threaded member moves with the guide assembly as the guide assembly moves along a path defined by the longitudinal axis of the elongated support.

Further, various embodiments of the invention are directed to a method for assembly a vehicle jack that includes engaging a threaded member with an elongated support member and a guide bracket. The elongated support member has a longitudinal axis and rotation of the elongated support member about the longitudinal axis causes the threaded member to move the guide bracket along a path defined by the longitudinal axis.

BRIEF DESCRIPTION OF THE SEVERAL VIEWS OF THE DRAWING(S)

In the description below, reference will be made to the accompanying drawings, which are not necessarily drawn to scale. Like numbers refer to like elements throughout.

DETAILED DESCRIPTION OF THE INVENTION

Various embodiments of the present invention now will be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Structure and Assembly of Various Embodiments of the Invention

Ratchet Driven Embodiment

Figure 1:
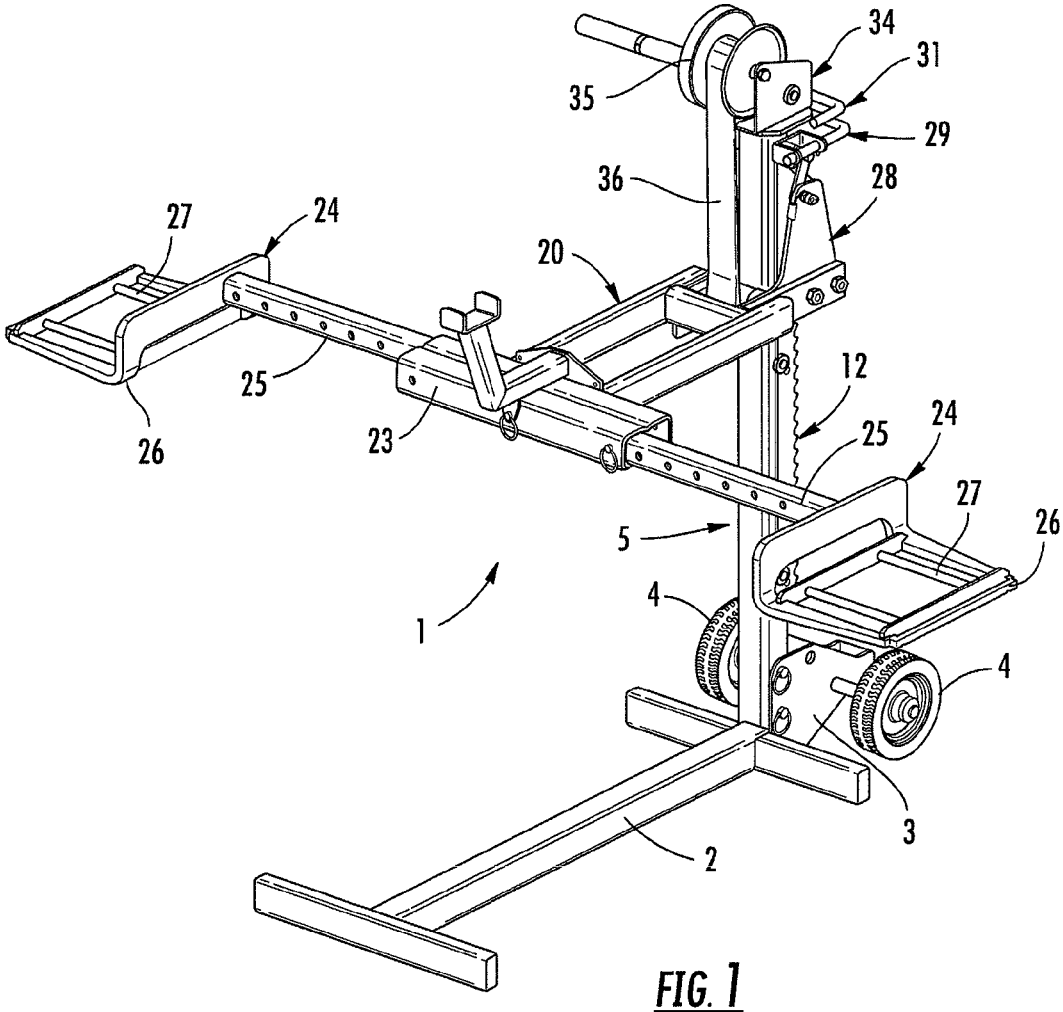
FIG. 1 is a perspective view of an improved vehicle jack according to a particular embodiment of the invention.
Figure 3A:
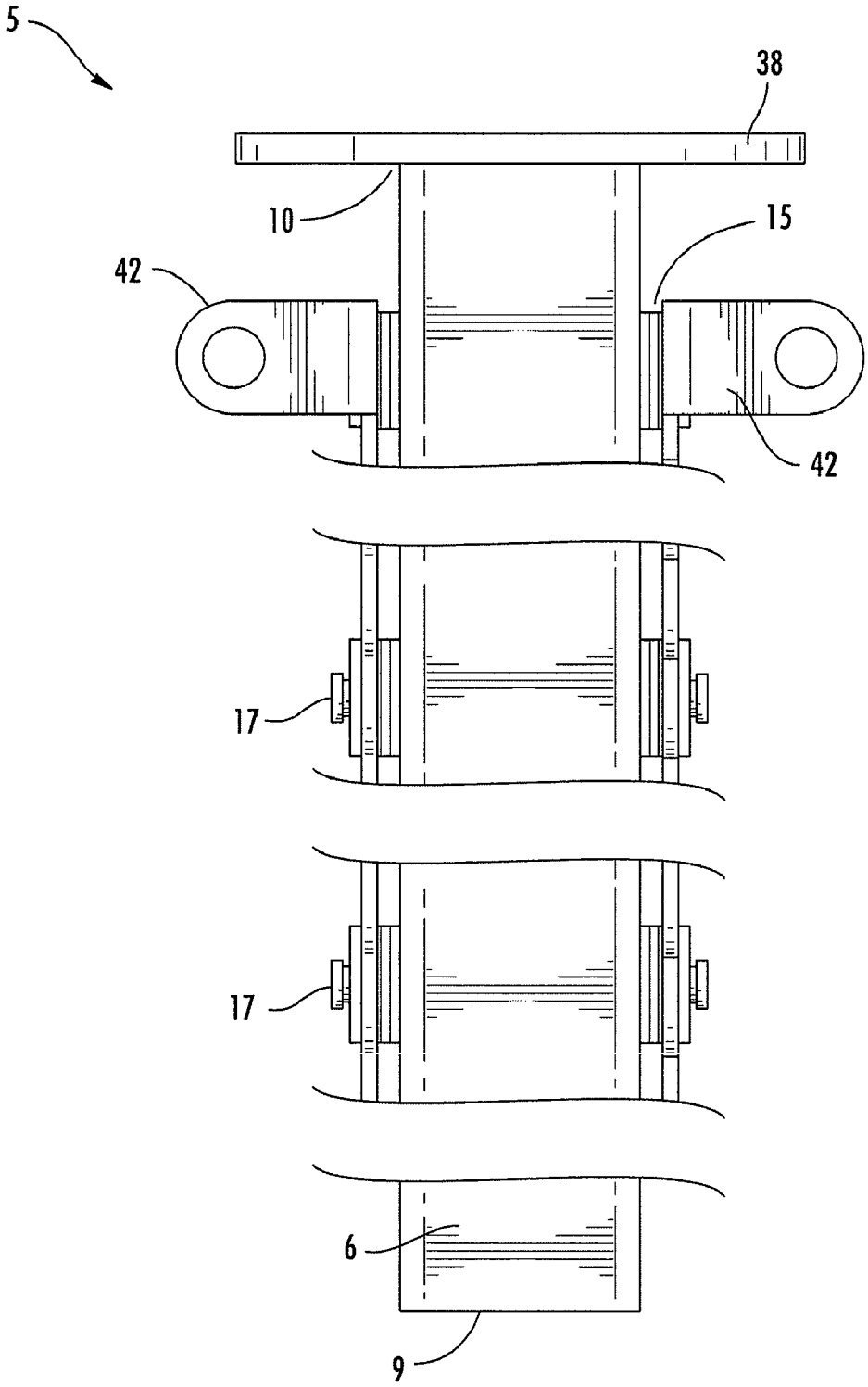
FIG. 3A is a front view of the upright support assembly of FIG. 2.

FIG. 1 shows a vehicle jack 1 according to a particular embodiment of the invention. As may be understood from this figure, in this embodiment, the vehicle jack 1 includes a base 2 that is generally I-shaped. An elongated upright support assembly 5 is mounted adjacent (e.g., to) the base 2 so that the upright support assembly 5 extends upwardly away from the base 2 in a substantially vertical (e.g., vertical) orientation. In particular embodiments of the invention, a wheel bracket 3 is mounted to the vehicle jack 1 adjacent to the point at which the base 2 attaches to the upright support assembly 5. This wheel bracket 3 is adapted to support one or more wheels 4 that are used to facilitate the movement of the vehicle jack 1 along a support surface. In particular embodiments, the vehicle jack 1 also includes a jack handle assembly 31 to facilitate movement of the vehicle jack 1. In the embodiment shown in FIG. 1, the jack handle assembly 31 is mounted adjacent an upper (e.g., a second) end 10 of the upright support assembly 5 (see FIG. 3A).

In the embodiment shown in FIG. 1, the vehicle jack 1 includes a lifting frame assembly 20. As may be understood from FIG. 1, the lifting frame assembly 20 generally includes a central support 23, a ratchet assembly 28, and at least one (e.g., two, in the embodiment shown in FIG. 1) wheel support assembly 24. In various embodiments of the invention, each wheel support assembly 24 includes a wheel support 26 and a wheel support mounting bar 25 that extends between the central support 23 and the wheel support 26. In various embodiments of the invention, each wheel support mounting bar 25 is slideably attached adjacent (e.g., in a telescoping arrangement) the central support 23. In particular embodiments, each wheel support mounting bar 25 includes an adjustment mechanism (e.g., a pin/hole arrangement such as the arrangement shown in FIG. 1) that is adapted: (1) for allowing a user to selectively adjust the lateral position of the wheel support mounting bar 25 (and, therefore, the corresponding wheel support 26 relative to the central support 23); and (2) selectively maintaining the wheel support mounting bar 25 in any of a plurality of desired lateral positions.

In various embodiments of the invention, the ratchet assembly 28 of the lifting frame assembly 20 is attached adjacent (e.g., to) the upright support assembly 5 to permit movement of the ratchet assembly 28 (and, therefore, the lifting frame assembly 20) along the length of the upright support assembly 5. In the embodiment shown in FIG. 1, travel of the ratchet assembly 28 along the length of the upright support assembly 5 is limited in the downward direction by a horizontal bar 75 disposed adjacent a lower end 9 of the upright support assembly 5 (see FIG. 2). The vehicle jack 1, according to various embodiments of the invention, includes a lifting frame assembly elevation assembly for moving the ratchet assembly 28 and the lifting frame assembly 20 upwardly relative to the upright support assembly 5. In the depicted embodiment, the lifting frame assembly elevation assembly includes a winch assembly 34 that is mounted adjacent (e.g., to) an upper end of the upright support assembly 5. In various embodiments, this winch assembly 34 is automatically driven (e.g., via an electric motor). However, in the embodiment shown in FIG. 1, the winch assembly 34 is driven manually, via a hand crank.

The depicted winch assembly 34 further includes a brake winch 35 and a winch belt 36, each commonly known and understood in the art. In various embodiments of the invention, a lower (e.g., a first) end of the winch belt 36 is attached adjacent (e.g., to) to the ratchet assembly 28 and an upper (e.g., a second) end of the winch belt 36 is attached adjacent (e.g., to) the brake winch 35. Turning the brake winch 35 in a take-up direction winds the winch belt 36 about a take-up spool associated with the brake winch 35. This causes the winch belt 36 to move the ratchet assembly 28 upwardly along a length of the upright support assembly 5. Similarly, turning the brake winch 35 in a belt release direction (which may be, for example, opposite to the take-up direction), causes the lower end of the winch belt 36 to pay out (e.g., unwind) from the brake winch's take up spool. This, in turn, causes the ratchet assembly 28 to move downwardly along the length of the upright support assembly 5. In various other embodiments (not shown), the winch assembly includes a chain or other elongated, flexible, connecting member instead of the winch belt 36 shown in FIG. 1.

As may be understood from FIGS. 1, 2, 3A, and 3B, in particular embodiments, the vehicle jack 1 includes at least one toothed rack assembly 12 that is mounted adjacent (e.g., to) the vehicle jack's upright support assembly 5. In the embodiment shown, the toothed rack assembly 12 includes two toothed bars 13 (shown in FIG. 2) that are spaced apart from each other. However, in alternative embodiments, the toothed rack assembly 12 may include any other suitable rack structure, including those with less or more than two toothed bars 13. In the embodiment shown in FIG. 2, each toothed bar 13 includes a lower (e.g., a first) end 14 and an upper (e.g., a second) end 15 and is mounted in a substantially vertical (e.g., vertical) orientation adjacent (e.g., to) a respective side surface of the upright support assembly 5. Further, each toothed bar 13, according to a particular embodiment of the invention, defines a plurality of ratchet teeth 16 that extend outwardly from a rear edge of the toothed bar 13 (see FIG. 2). At least a portion of the plurality of ratchet teeth 16 of one of the toothed bars 13 is substantially horizontally aligned with at least a portion of the plurality of ratchet teeth 16 of the other toothed bar 13.

Figure 2:
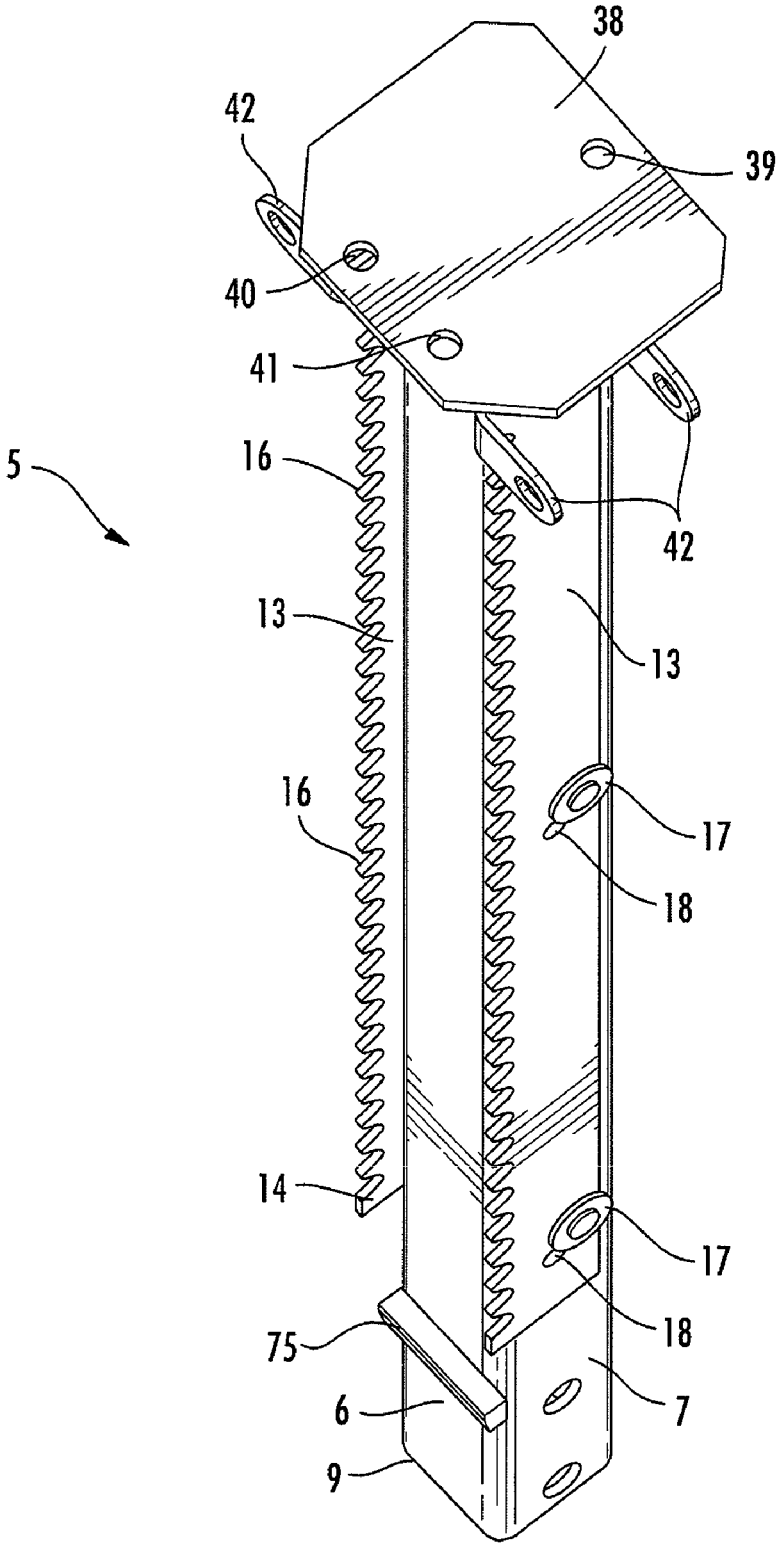
FIG. 2 is a perspective view of an upright support assembly of the vehicle jack of FIG. 1.
Figure 3B:
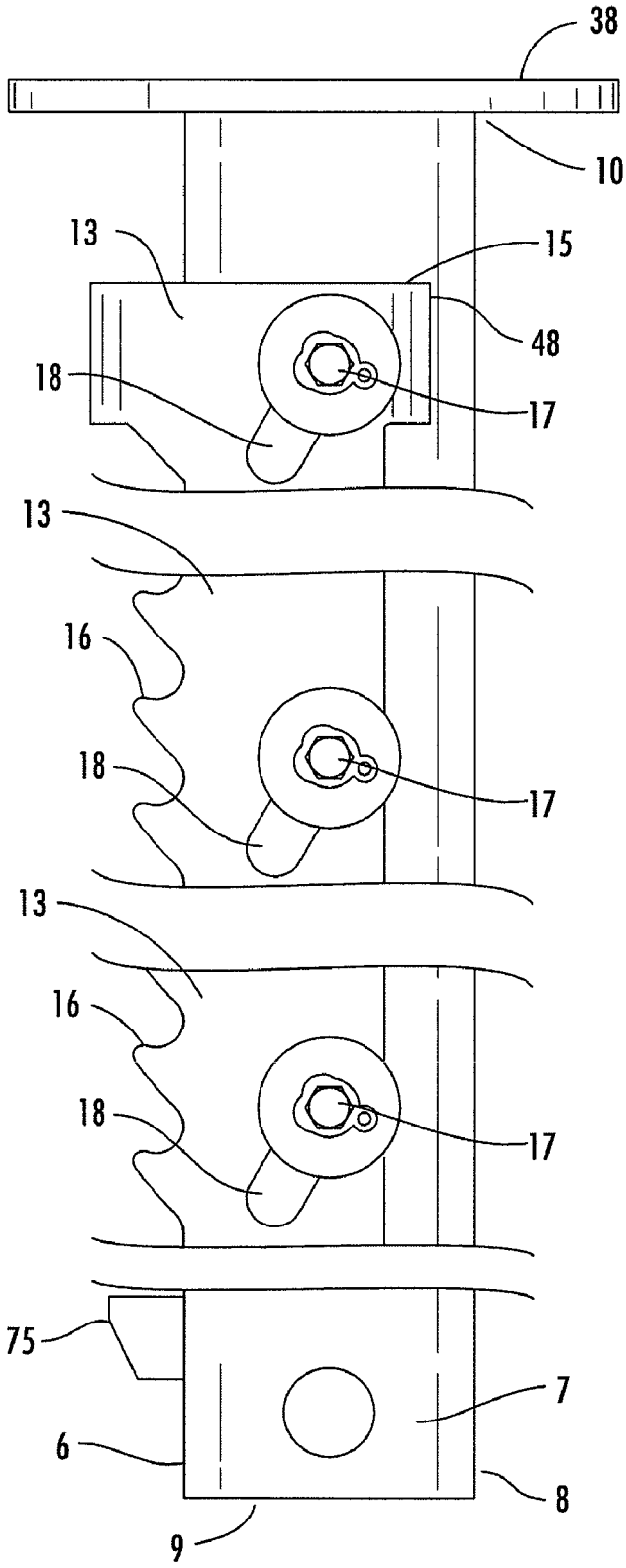
FIG. 3B is a side view of the upright support assembly of FIG. 2.

In particular, as may be understood from FIG. 2, in various embodiments of the invention, each toothed bar 13 defines at least two elongated, angled pin slots 18 designed to slideably receive a corresponding toothed bar mounting pin 17 (see also FIG. 3B). Each angled pin slot 18 is disposed between the rear edge of the toothed bar 13 and a front edge of the toothed bar 13 (which is opposite and spaced apart from the rear edge) such that an upper end of each slot 18 is disposed adjacent the front edge of the toothed bar 13 and a lower end of each slot 18 is disposed adjacent the rear edge of the toothed bar 13. In various embodiments of the invention, the respective toothed bar mounting pins 17 mount each toothed bar 13 to a respective one of the upright support assembly's side surfaces 7. In alternative embodiments (not shown), the slots may have an alternative shape and/or orientation to that shown in FIG. 2, such as, for example, substantially L-shaped or substantially horizontal.

Figure 7:
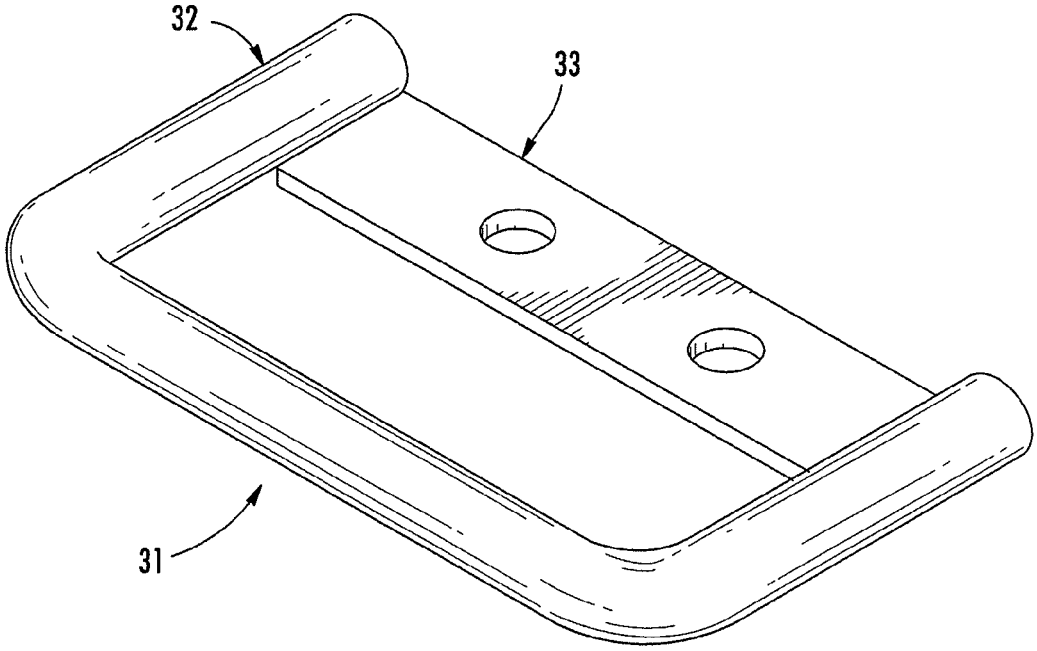
FIG. 7 is a perspective view of a jack handle assembly of the vehicle jack of FIG. 1.

In a particular embodiment of the invention, the upright support assembly 5 includes a top plate 38 mounted adjacent (e.g., to) a second end 10 of the upright support assembly 5. The top plate 38 includes a first opening 39 that may be used to receive a fastener for mounting the winch assembly 34 to the upright support assembly 5. In various embodiments of the invention, the top plate 38 further includes a second opening 40 and a third opening 41 that may receive additional fasteners for mounting the jack handle assembly 31 to the upright support assembly 5. As may be understood from FIG. 7, in a particular embodiment of the invention, the jack handle assembly 31 may include two arms 32 and a mounting plate 33 that extends between the arms 32. In a particular embodiment, the mounting plate 33 may be adapted to be attached adjacent a top surface of the top plate 38, as shown generally in FIG. 5, using one or more fasteners (e.g., bolts, screws, adhesive, clip, and/or other suitable fasteners).

Figure 4:
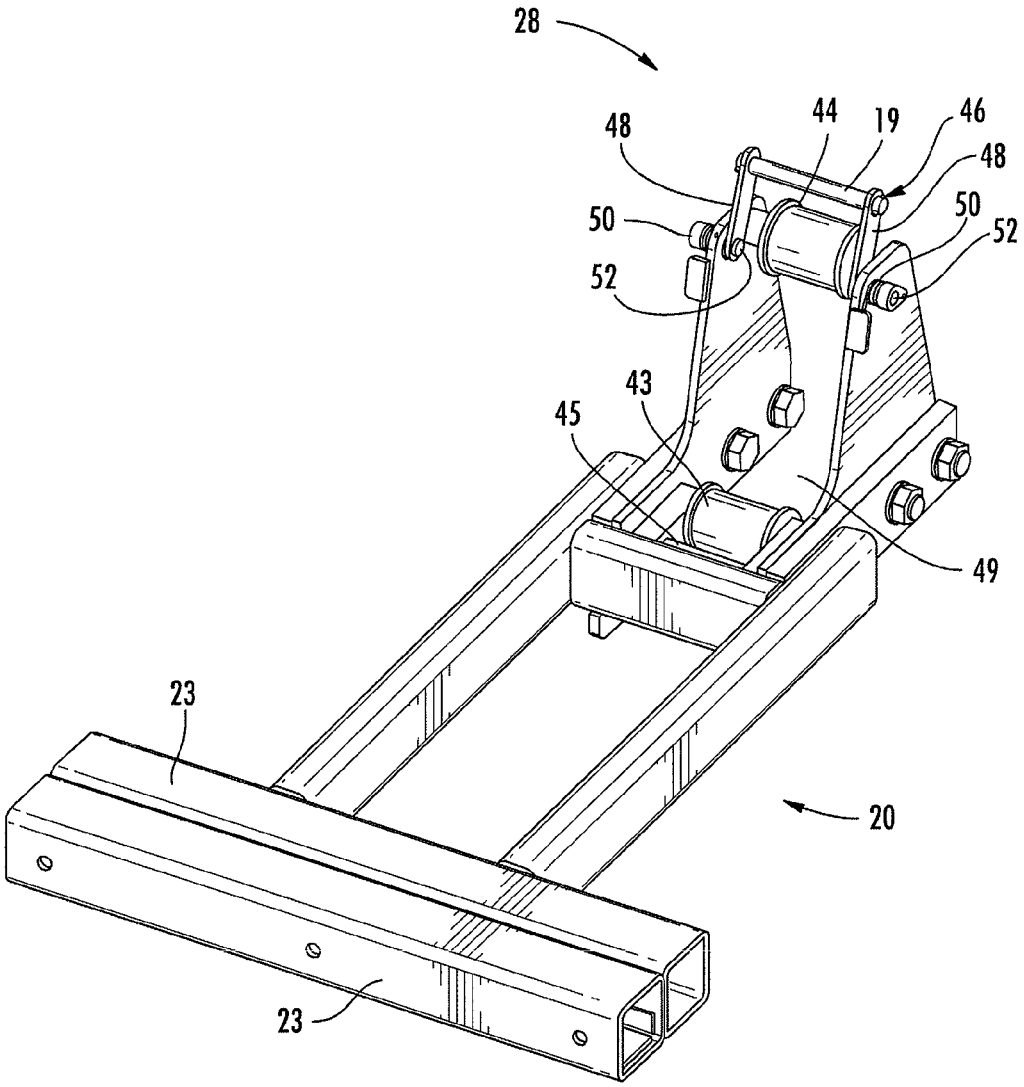
FIG. 4 is perspective view of one embodiment of a lifting frame assembly of the vehicle jack of FIG. 1.

As may be understood from FIG. 4, the ratchet assembly 28, according to a particular embodiment of the invention, includes at least a first roller 43 and a second roller 44. In various embodiments of the invention, the first roller 43 is positioned adjacent a front surface 8 of the upright support assembly 5, and the second roller 44 is positioned adjacent a rear surface 6 of the upright support assembly 5 (see FIGS. 1 and 4). A first channel 49 is defined between the first 43 and second rollers 44, and the upright support assembly 5 extends through the first channel.

Figure 5:
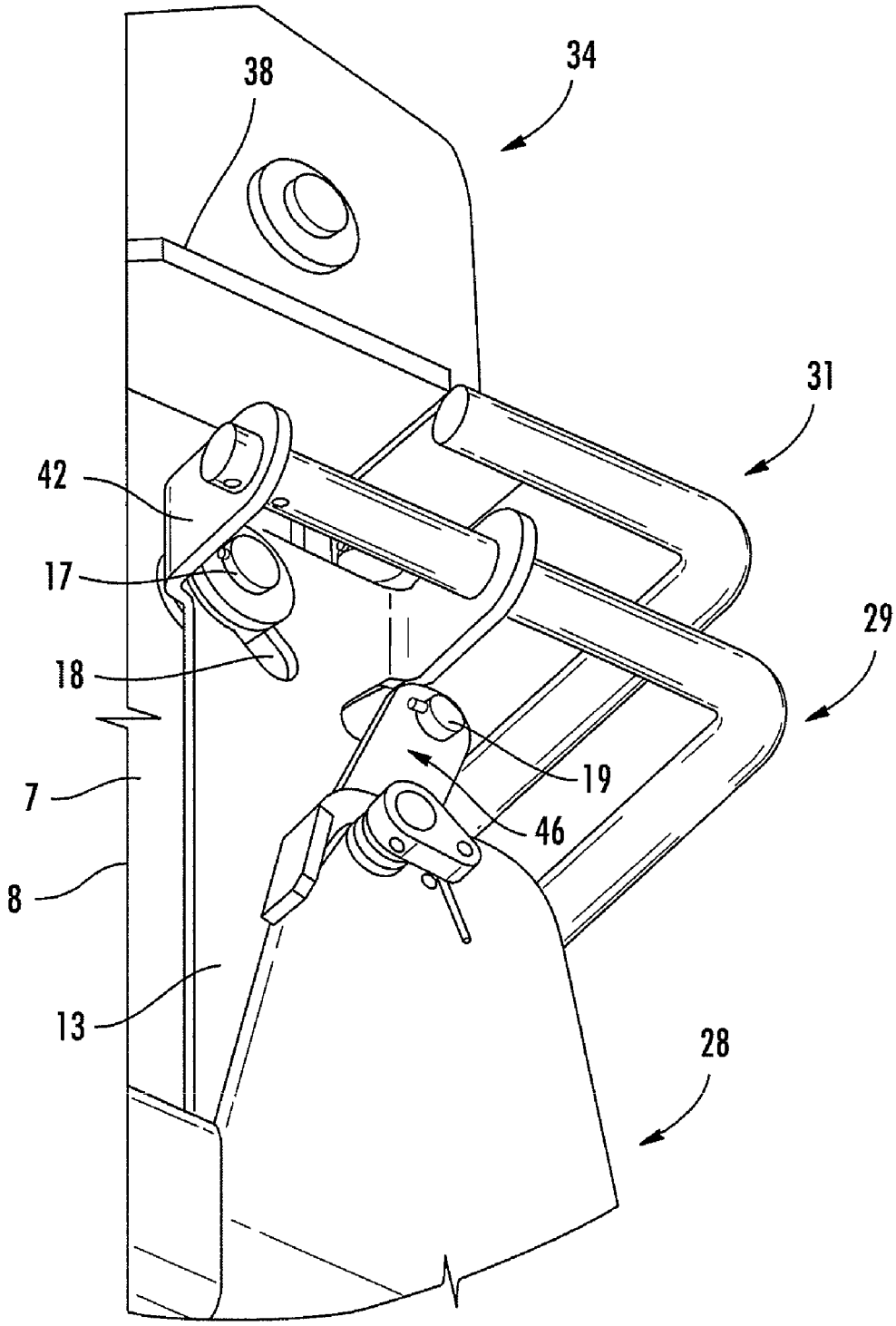
FIG. 5 is a perspective view of a safety stop release mechanism of the vehicle jack of FIG. 1.

The ratchet assembly 28, according to various embodiments of the invention, also includes a torque arm assembly 46 and a toothed bar engagement pin 19 (see FIGS. 4 and 5). In various embodiments of the invention, as described in greater detail below, the torque arm assembly 46 urges the toothed bar engagement pin 19 toward one of the plurality of troughs between the toothed rack assembly's teeth 16 (see FIG. 3B) as the winch assembly 34 moves the ratchet assembly 28 vertically relative to the upright support assembly 5. In a particular embodiment of the invention, the vertical movement of the ratchet assembly 28 is physically limited between the lower end 14 of the toothed bar 13 and the upper end 15 of the toothed bar 13 (see FIGS. 2 and 3A). In an alternative embodiment of the invention, the vertical movement of the ratchet assembly 28 is physically limited between the horizontal bar 75 and the upper end 15 of the toothed bar 13 (see FIG. 3B). As described in more detail below, in various embodiments, urging the toothed bar engagement pin 19 into a trough between the toothed rack assembly's teeth 16 prevents inadvertent vertical movement of the ratchet assembly 28 relative to the toothed rack assembly 12 (see FIG. 2).

In the embodiment shown in FIG. 4, the torque arm assembly 46 includes two arms 48 that extend substantially upwardly from a rear side of the ratchet assembly 28 adjacent the second roller 44. A pin 52 or other suitable fastener couples a lower portion of each arm 48 to the ratchet assembly 28, and the toothed bar engagement pin 19 extends between upper portions of the two arms 48. A torsion spring 50 is disposed around each of the pins 52 to bias the arms 48 in a direction away from the rear side of the ratchet assembly 28.

In the embodiment shown in FIG. 4, the ratchet assembly 28 includes a winch belt pin 45 that attaches the lower end of the winch belt 36 to the lifting frame assembly 20. In this embodiment, turning the brake winch 35 in a belt take-up direction winds the upper portion of the winch belt 36 about the brake winch's take-up spool. This, in turn, lifts the winch belt pin 45 that, in turn, moves the ratchet assembly 28 and the lifting frame assembly 20 upwardly along a length of the upright support assembly 5. In various embodiments of the invention, the movement of the winch belt pin 45 is limited by the upper end 15 of the toothed bar 13 and the lower end 14 of the toothed bar 13 (see FIG. 3B).

Figure 6:
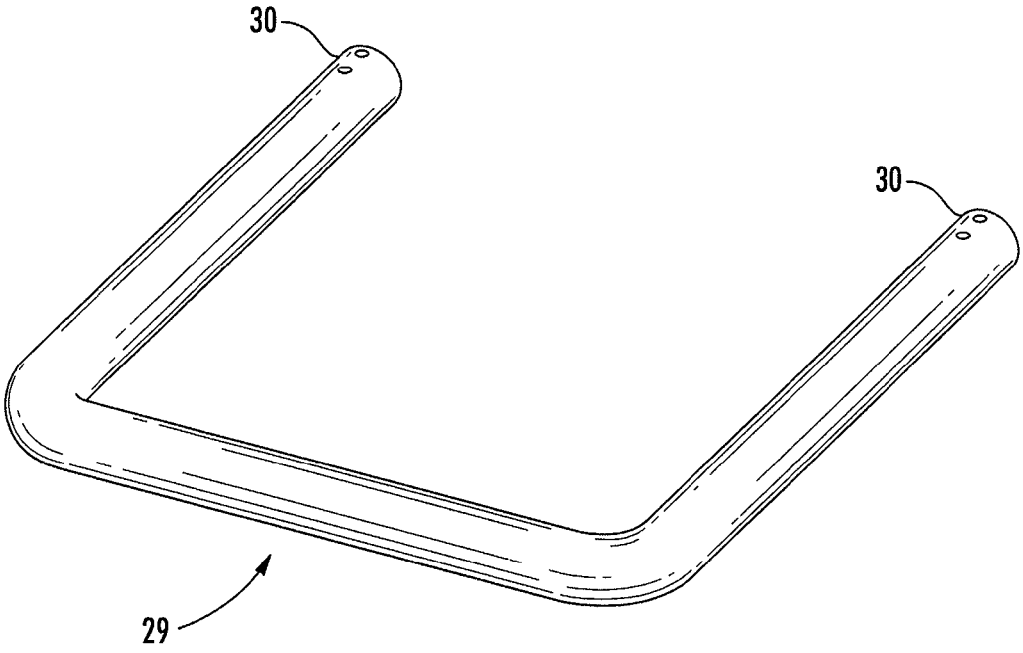
FIG. 6 is a perspective view of a release handle assembly of the vehicle jack of FIG. 1.

As may be understood from FIGS. 2 and 5, the toothed bar 13, according to a particular embodiment of the invention, includes at least two release handle assembly mounting plates 42. In various embodiments, the release handle assembly mounting plates 42 are positioned at the upper end 15 of the toothed bar 13. The mounting plates 42 are adapted to receive and support a release handle assembly 29. In various embodiments of the invention, as may be understood from FIG. 6, the release handle assembly 29 contains at least two mounting holes 30 that are used to facilitate locking the release handle assembly 29 to the mounting plates 42 (e.g., via one or more fasteners, such as hair pins).

As previously disclosed, the ratchet assembly 28, according to the embodiment shown in FIG. 4, includes at least a first roller 43 disposed adjacent a front surface 8 (shown in FIG. 3B) of the upright support assembly 5 and a second roller 44 disposed adjacent a rear surface 6 (shown in FIG. 3B) of the upright support assembly 5. As may be understood from FIGS. 8 and 9, a ratchet assembly 128, according to an alternative embodiment of the invention, further includes at least two side rollers 155 disposed on opposing and spaced apart sides of the first channel 49 defined between the first 43 and second rollers 44. The side rollers 155 engage opposing and spaced apart side surfaces of the upright support assembly 5 as the upright support assembly 5 travels through the first channel.

Figure 8:
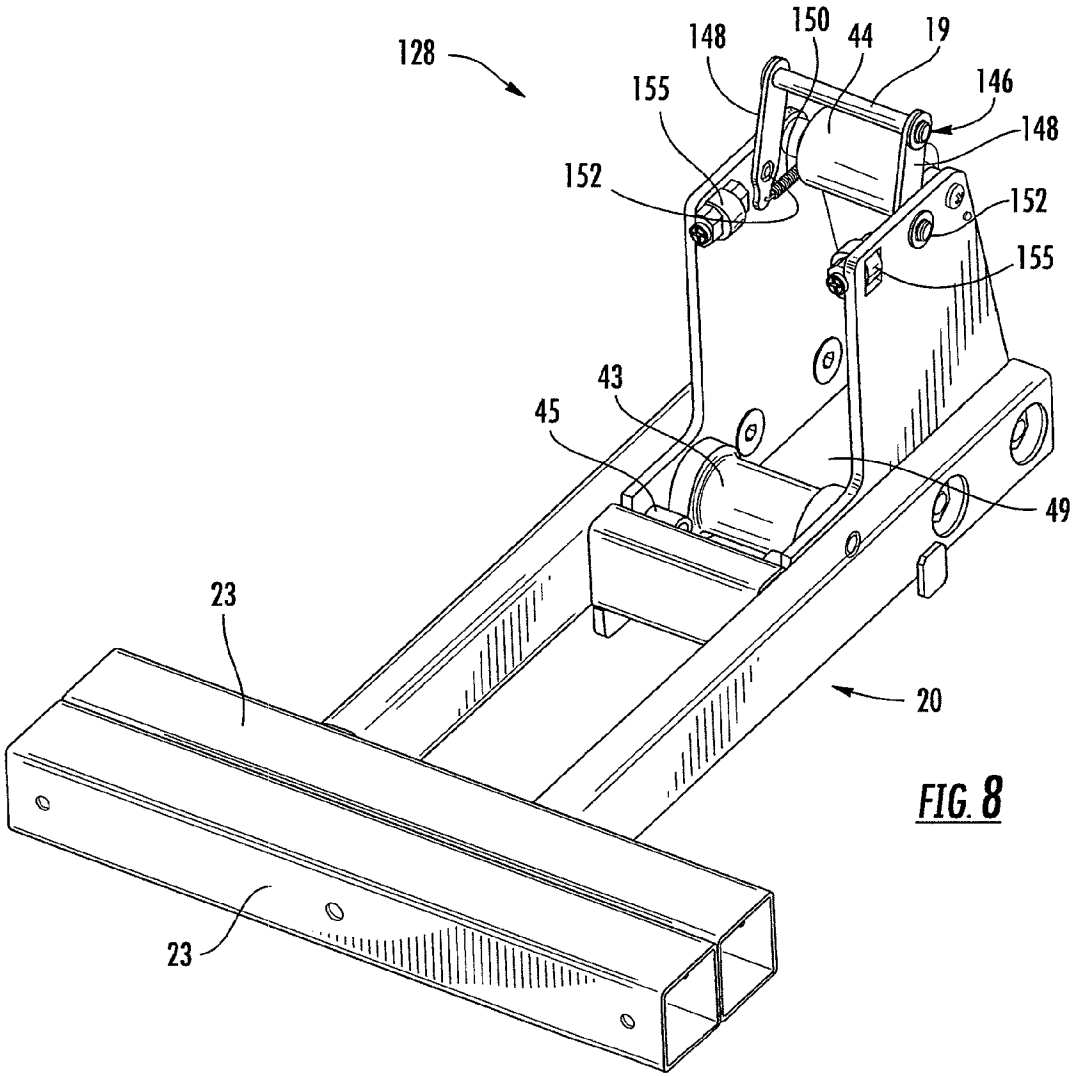
FIG. 8 is a perspective view of an alternative embodiment of a lifting frame assembly.
Figure 9:
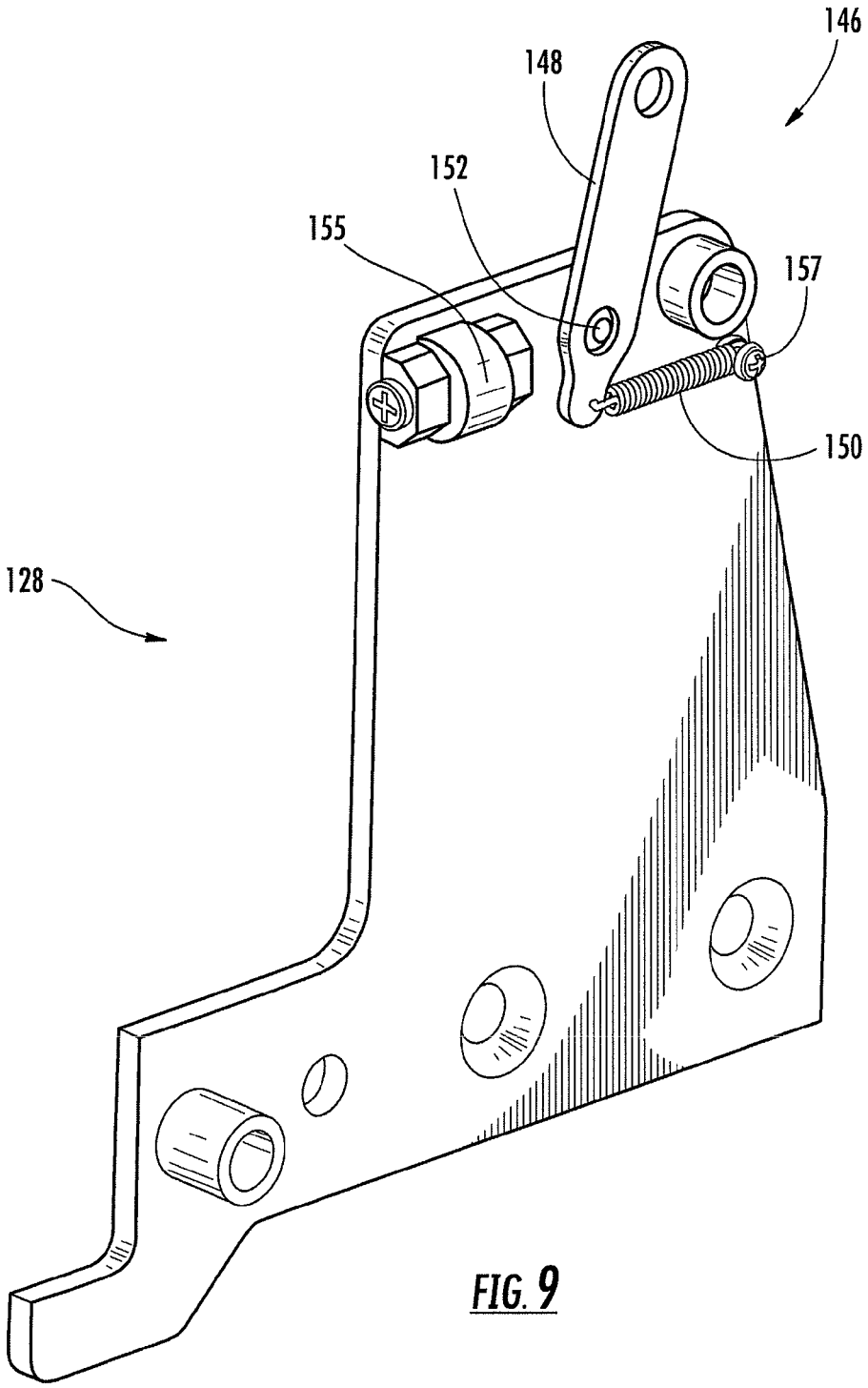
FIG. 9 is a perspective view of a ratchet assembly of the lifting frame assembly of FIG. 8.

FIGS. 8 and 9 also illustrate an alternative embodiment of a torque arm assembly 146 and the ratchet assembly 128. The torque arm assembly 146 includes two arms 148 that extend substantially upwardly from a rear side of the ratchet assembly 128 adjacent the second roller 44. A pin 152 or other suitable fastener couples a lower portion of each arm 148 to the ratchet assembly 128, and the toothed bar engagement pin 19 extends between upper portions of the two arms 148. One end of a helical spring 150 is attached to each of the pins 152 and an opposing end of the helical spring 150 is anchored with a screw 157 or other suitable fastener so as to bias the arms 148 in a direction away from the rear side of the ratchet assembly 128. In other various embodiments (not shown), the arms and/or the engagement pin are biased using other suitable biasing means, such as another type of spring or using materials for the arms and/or engagement pin having an inherent resiliency.

Screw Driven Embodiment

Figure 10:
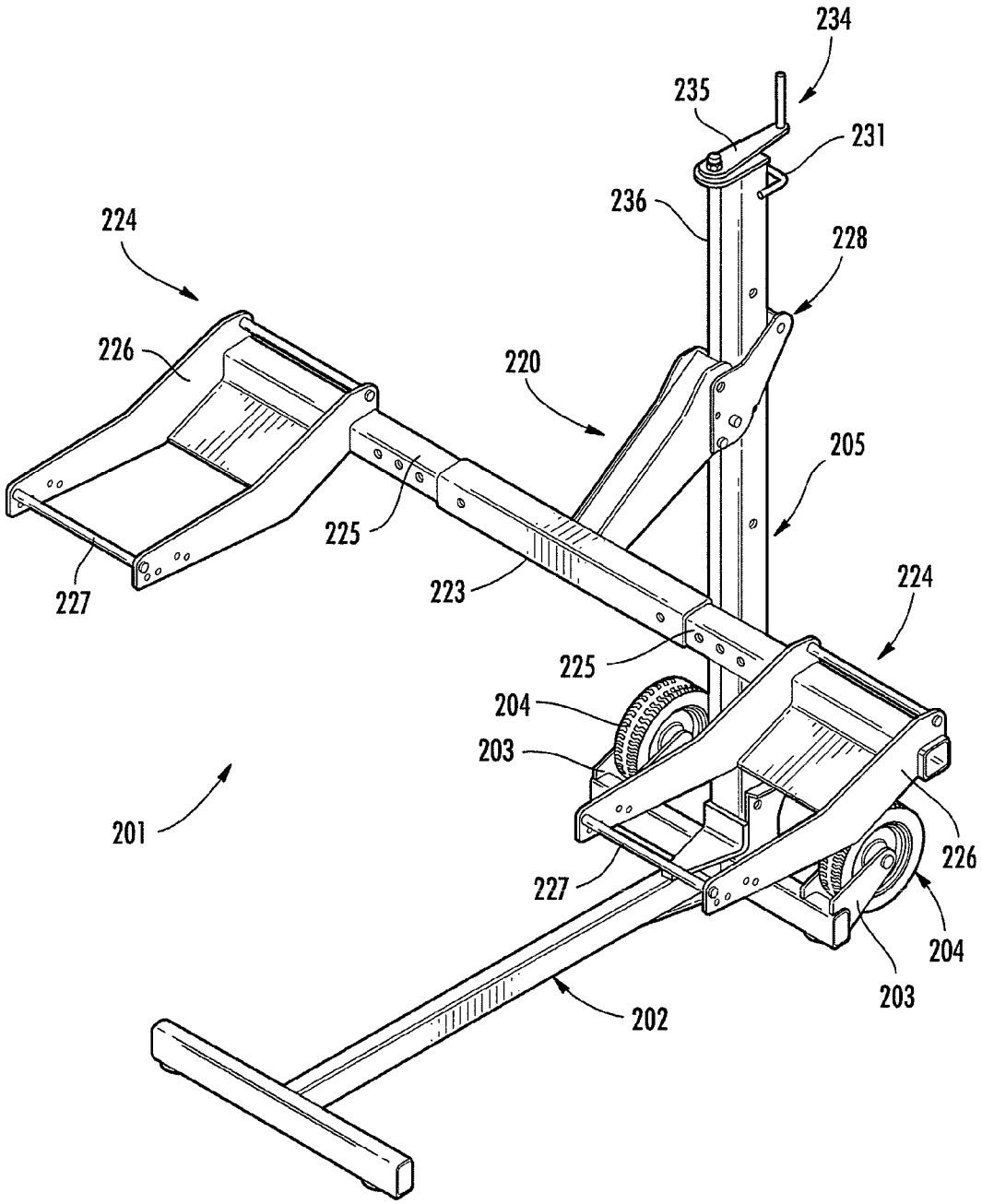
FIG. 10 is a perspective view of an improved vehicle jack according to an alternative embodiment of the invention.

FIG. 10 shows a vehicle jack 201 according to an alternative embodiment of the invention. As may be understood from this figure, in this embodiment, the vehicle jack 201 includes a base 202 that is generally I-shaped. An elongated upright support assembly 205 is mounted adjacent (e.g., to) the base 202 so that the upright support assembly 205 extends upwardly away from the base 202 in a substantially vertical (e.g., vertical) orientation. In certain embodiments, at least two wheel brackets 203 are mounted to the vehicle jack 201 substantially adjacent to the point at which the base 202 attaches to the upright support assembly 205. The two wheel brackets 203 are configured to support one or more wheels 204 that are used to facilitate the movement of the vehicle jack 201 along a support surface. In particular embodiments, the vehicle jack 201 also includes a jack handle assembly 231 to facilitate movement of the vehicle jack 201. In the embodiment shown in FIG. 10, the jack handle assembly 231 is mounted adjacent an upper (e.g., a second) end 210 of the upright support assembly 205 (see FIG. 12).

In the embodiment shown in FIG. 10, the vehicle jack 201 includes a lifting frame assembly 220. The lifting frame assembly 220 generally includes a central support 223, a guide assembly 228, and at least one (e.g., two, in the embodiment shown in FIG. 10) wheel support assembly 224. In various embodiments of the invention, each wheel support assembly 224 includes a wheel support 226 and a wheel support mounting bar 225 that extends between the central support 223 and the wheel support 226. In various embodiments of the invention, each wheel support mounting bar 225 is slideably attached adjacent (e.g., in a telescoping arrangement) the central support 223. In particular embodiments, each wheel support mounting bar 225 includes an adjustment mechanism (e.g., a pin/hole arrangement) that is configured for: (1) allowing a user to selectively adjust the lateral position of the wheel support mounting bar 225 (and, therefore, the corresponding wheel support 226 relative to the central support 223); and (2) selectively maintaining the wheel support mounting bar 225 in any of a plurality of desired lateral positions. As commonly known and understood by those skilled in the art, the at least one wheel support assembly 224, the wheel support mounting bar 225, and the central support 223 together, comprise a vehicle engaging portion of the vehicle jack 201.

Figure 13:
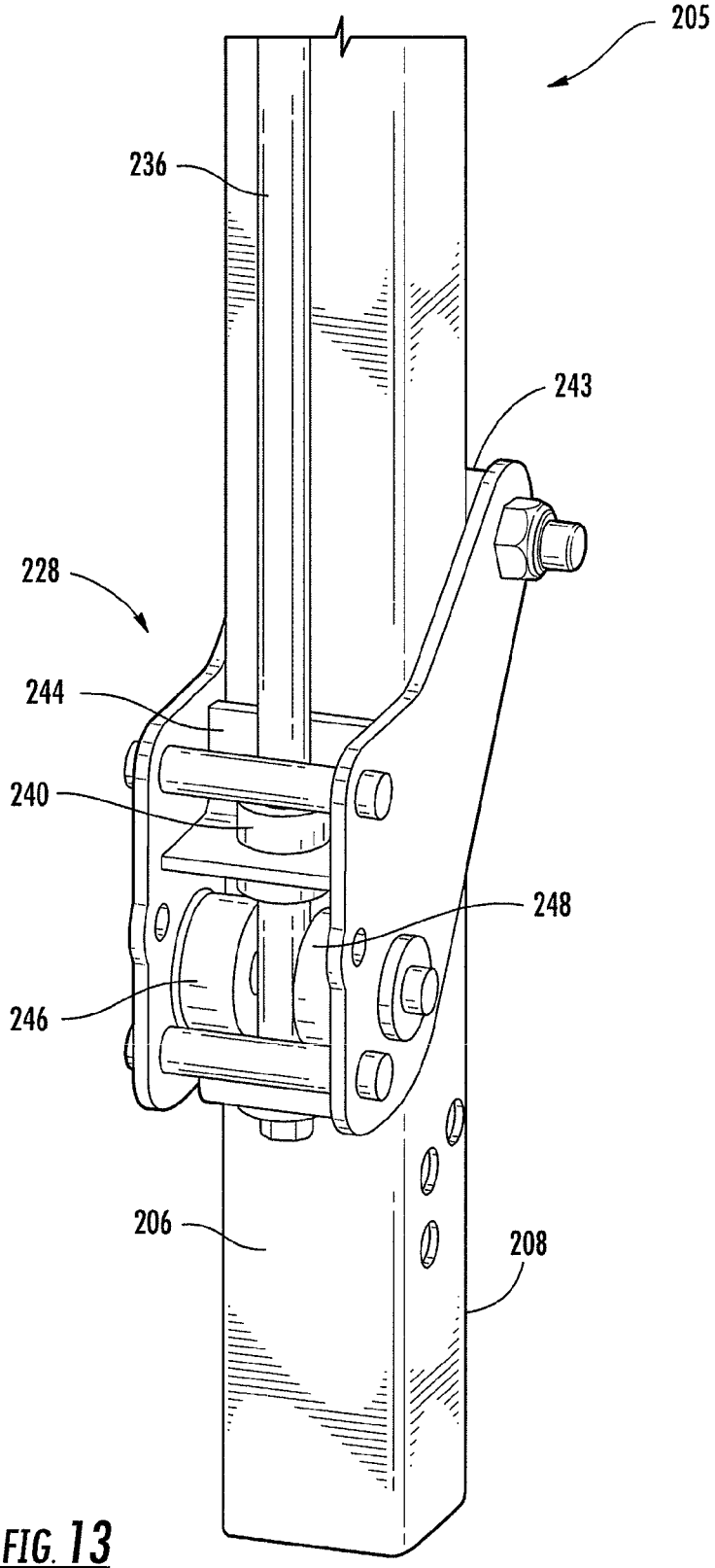
FIG. 13 is a perspective view of the guide assembly and the upright support assembly of the vehicle jack of FIG. 10.
Figure 14:
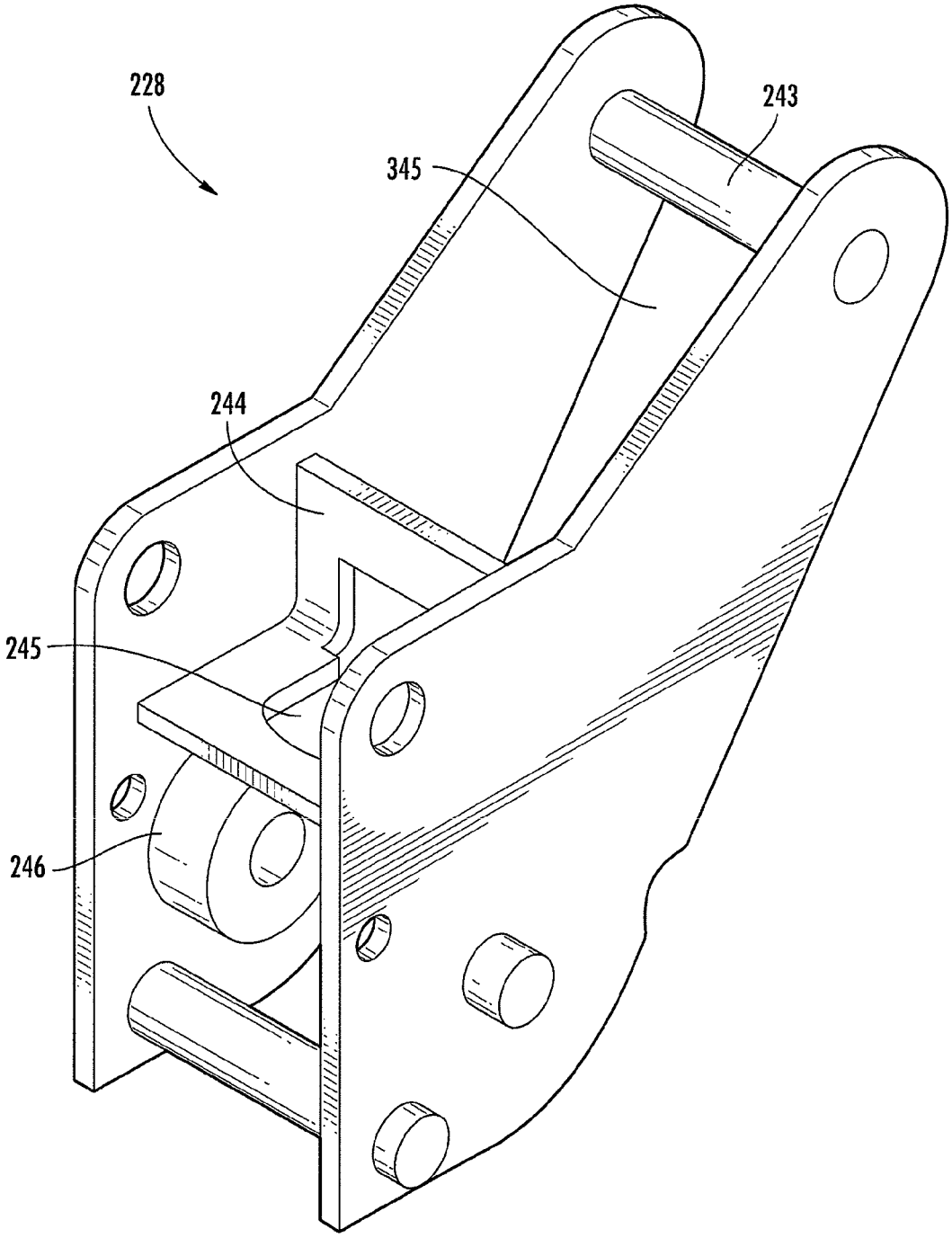
FIG. 14 is a perspective view of the guide assembly of the vehicle jack of FIG. 10.

As may be understood from FIGS. 13 and 14, the guide assembly 228, according to various embodiments of the invention, includes a first roller 243, a second roller 246, and a guide bracket 244. In the embodiment shown in FIG. 13, the guide assembly 228 also includes a third roller 248. In various embodiments of the invention, the first roller 243 is disposed adjacent a rear surface 208 of the upright support assembly 205 (see FIG. 11). The second roller 246 and the guide bracket 244 are disposed adjacent a front surface 206 of the upright support assembly 205 (see FIGS. 10 and 13). As shown in the embodiment of FIG. 13, the third roller 248 is disposed adjacent the front surface 206 and spaced apart from the second roller 246. A first channel 345 (shown in FIG. 14) is defined between the first roller 243 and the second roller 246 (and also, in certain embodiments, the third roller 248), and the upright support assembly 205 extends through and moves along the first channel 345. In particular embodiments, at least a portion of the guide bracket 244 also defines the channel 345 (see FIG. 14). In various embodiments, as the guide assembly 228 travels along the upright support assembly 205, the first roller 243 and the second roller 246 engage opposing and spaced apart front 206 and rear 208 surfaces of the upright support assembly 205 (see FIG. 13). In particular embodiments, the third roller 248 engages the front surface 206 as the guide assembly 228 travels along the upright support assembly 205. In particular embodiments, at least a portion of the guide bracket 244 also engages the front surface 206 as the guide assembly 228 travels along the upright support assembly 205.

Figure 17A:
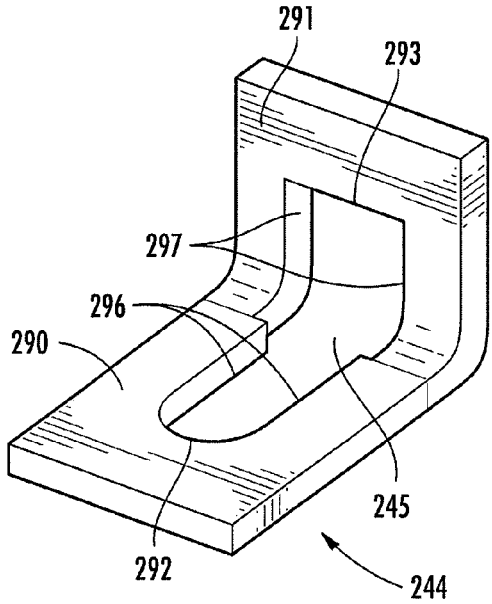
FIG. 17A is a perspective view of a guide bracket of the guide assembly of FIGS. 13 and 14.

As may be understood from FIGS. 14 and 17A, in particular embodiments, the guide bracket 244 may be substantially L-shaped and includes a substantially horizontal portion 290 and a substantially vertical portion 291. In certain embodiments, the guide bracket 244 defines an interior opening (e.g., a second channel) 245. In the embodiment shown in FIG. 17A, the substantially horizontal portion 290 defines a substantially U-shaped channel 292, and the substantially vertical portion 291 defines a substantially rectangular-shaped channel 293. The U-shaped channel 292 and the rectangular-shaped channel 293 together form the interior opening 245. In particular embodiments, as shown in FIGS. 17B and 17C, a width 294 of the rectangular-shaped channel 293 is greater than a width 295 of the U-shaped channel 292 along an axis extending through the vertical portion 291 and the horizontal portion 290.

Figure 17B:
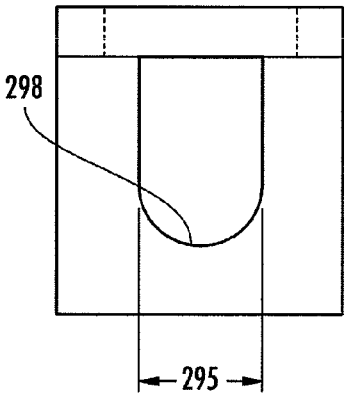
FIG. 17B is a top view of the guide bracket of FIG. 17A.
Figure 17C:
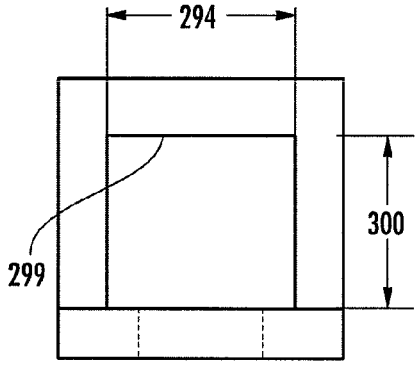
FIG. 17C is a front view of the guide bracket of FIG. 17A.

As may be understood from FIGS. 17A-C, in various embodiments, the U-shaped channel 292 in the guide bracket 244 includes two opposing and spaced apart interior side surfaces 296 and an interior front surface 298. In particular embodiments, the interior front surface 298 forms an arc between the interior side surfaces 296. In the depicted embodiment, the rectangular-shaped channel 293 defined by the guide bracket 244 includes two opposing and spaced apart interior side surfaces 297 and an interior end surface 299. In particular embodiments, the interior end surface 299 is substantially planar.

Figure 15:
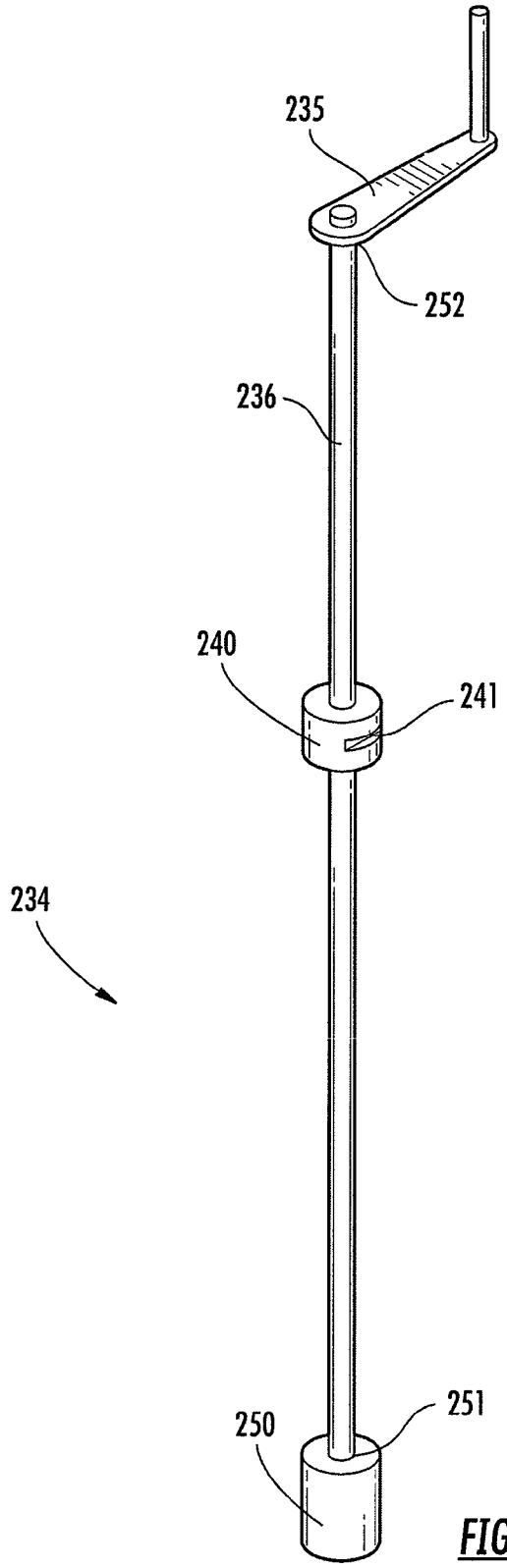
FIG. 15 is a perspective view of the elevation assembly of the vehicle jack of FIG. 10.
Figure 16A:
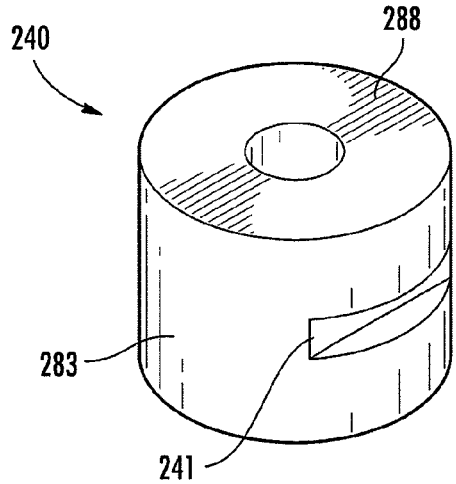
FIG. 16A is a perspective view of a threaded member of the elevation assembly of FIG. 15.
Figure 16B:
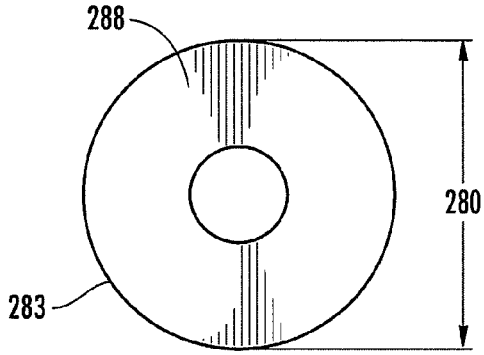
FIG. 16B is a top view of the threaded member of FIG. 16A.
Figure 16C:
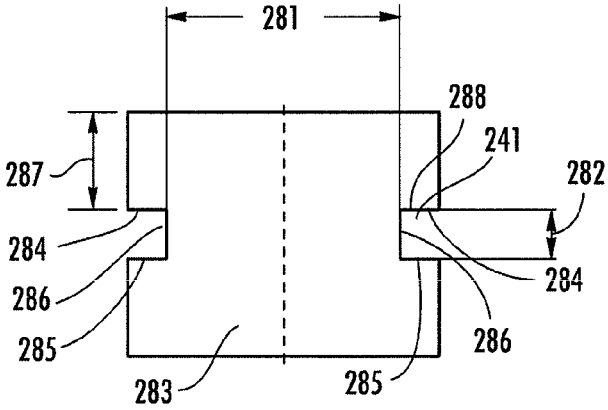
FIG. 16C is a front view of the threaded member of FIG. 16A.
Figure 16D:
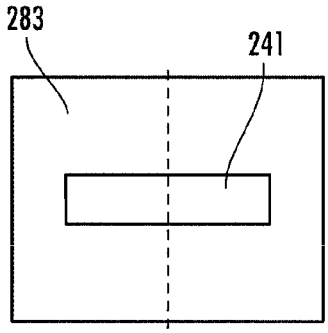
FIG. 16D is a side view of the threaded member of FIG. 16A.

Turning to FIG. 15, an elevation assembly 234, structured according to one embodiment, moves the guide assembly 228 (and, therefore, the lifting frame assembly 220) (see FIG. 10) upwardly relative to the upright support assembly 205. The depicted elevation assembly 234 includes an elongated support member 236 (e.g., a rod, bar, post, and/or any other suitable support member) and a threaded member 240 (e.g., a nut, washer, ring, and/or any other suitable threaded member). In certain embodiments, an exterior surface of the elongated support member 236 defines threads. Similarly, in certain embodiments, interior surfaces of the threaded member 240 and the base member 250 define threads that correspond with the threads of the elongated support member 236 such that the threaded member 240 and the base member 250 matingly engage the elongated support member 236. In this manner, rotation of the elongated support member 236 relative to the threaded member 240 results in travel of the threaded member 240 along a length of the elongated support member 236. The depicted elevation assembly 234 also includes a handle 235 that is mounted adjacent (e.g., to) the upper end 210 of the upright support assembly 205 (see FIG. 10). In various embodiments, the handle 235 is mounted adjacent (e.g., to) an upper end of the elongated support member 236, thereby, permitting rotation of the elevation assembly 234 (and, therefore, as disclosed later, travel of the lifting frame assembly 220 relative to the upright support assembly 205). In alternative embodiments, the elongated support member 236 is rotated automatically (e.g., via an electric motor).

As may be understood from FIGS. 16A-D, the threaded member 240, according to various embodiments, includes a top surface 288 and at least two grooves 241 located adjacent an exterior side surface 283 of the threaded member 240. In particular embodiments, the at least two grooves 241 include interior top surfaces 284, interior bottom surfaces 285, and interior back surfaces 286. In particular embodiments, the at least two grooves 241 are located on opposing and spaced apart sides of the threaded member 240. As may also be understood from FIGS. 16A-D, the interior back surfaces 286 are separated by a distance 281. In particular embodiments, the distance 281 is less than a diameter 280 of the threaded member 240. As may also be understood from FIGS. 11 and 13, the threaded member 240 is fixed relative to the guide assembly 228. In particular embodiments, engagement of the at least two grooves 241 with opposing and spaced apart surfaces on the guide assembly 228 (as disclosed in more detail later) fixes the threaded member 240 relative to the guide assembly 228.

Figure 11:
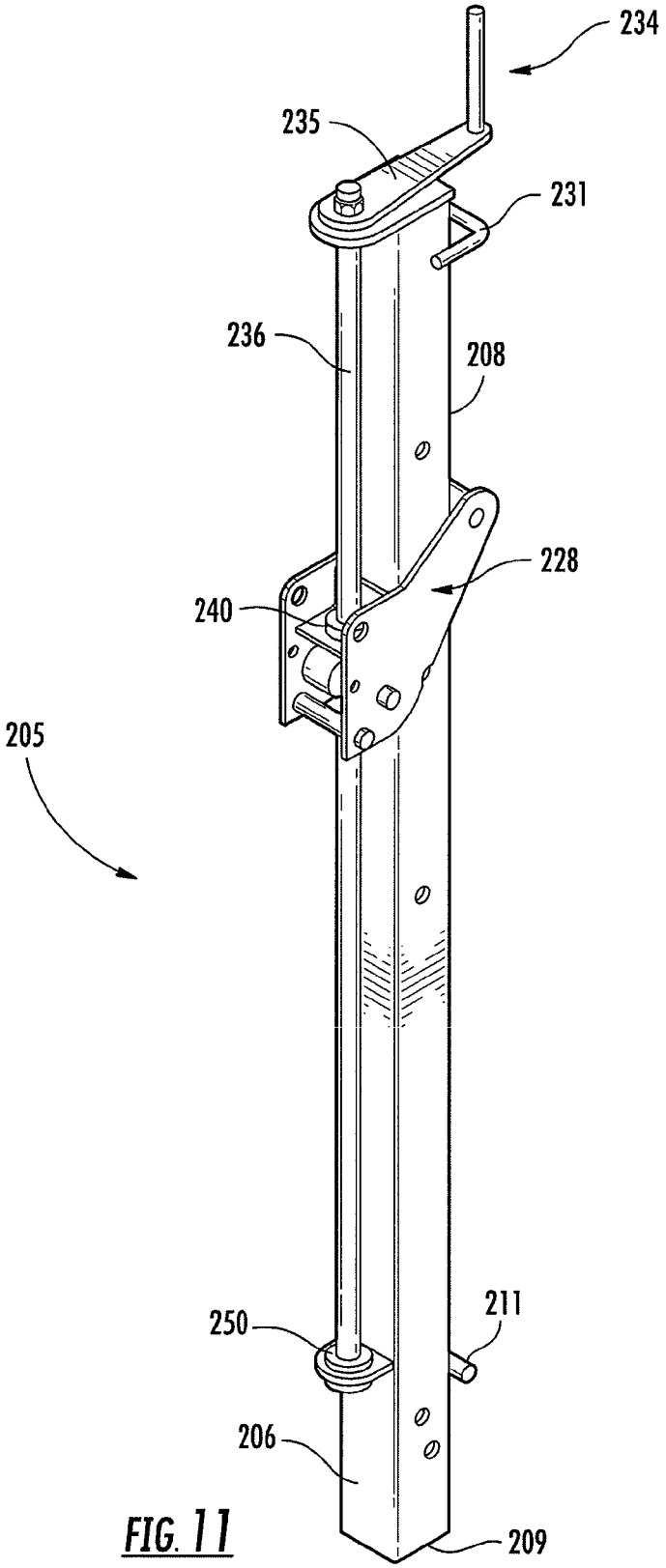
FIG. 11 is a perspective view of an upright support assembly of the vehicle jack of FIG. 10.

In various embodiments according to FIGS. 10 and 11, the guide assembly 228 of the lifting frame assembly 220 is mounted adjacent (e.g., to) the upright support assembly 205 to permit movement of the guide assembly 228 (and, therefore, the lifting frame assembly 220) along the length of the upright support assembly 205. In the embodiment shown in FIG. 11, travel of the guide assembly 228 along the length of the upright support assembly 205 is limited in the downward direction by a horizontal bar 211 disposed adjacent a lower (e.g. a first) end 209 of the upright support assembly 205. Similarly, travel of the guide assembly 228 along the length of the upright support assembly 205 is limited in the upward direction by the jack handle assembly 231 attached adjacent (e.g. to) the upper end 210 (see FIG. 12) of the upright support assembly 205.

According to various embodiments, the elevation assembly 234 is mounted adjacent (e.g. to) the upright support assembly 205. In particular embodiments (see FIG. 12), the upright support assembly 205 includes a first bracket 238 attached adjacent (e.g., to) the upper end 210 of the upright support assembly 205 and a second bracket 213 attached adjacent (e.g., to) the lower end 209 of the upright support assembly 205. As may be understood from FIG. 12, the first 238 and second 213 brackets each include an opening 310. In particular embodiments, the opening 310 is at least larger than a diameter of the elongated support member 236. In the embodiment shown in FIG. 12, the opening 310 is substantially circular and has a diameter at least greater than a diameter of the elongated support member 236.

Figure 12:
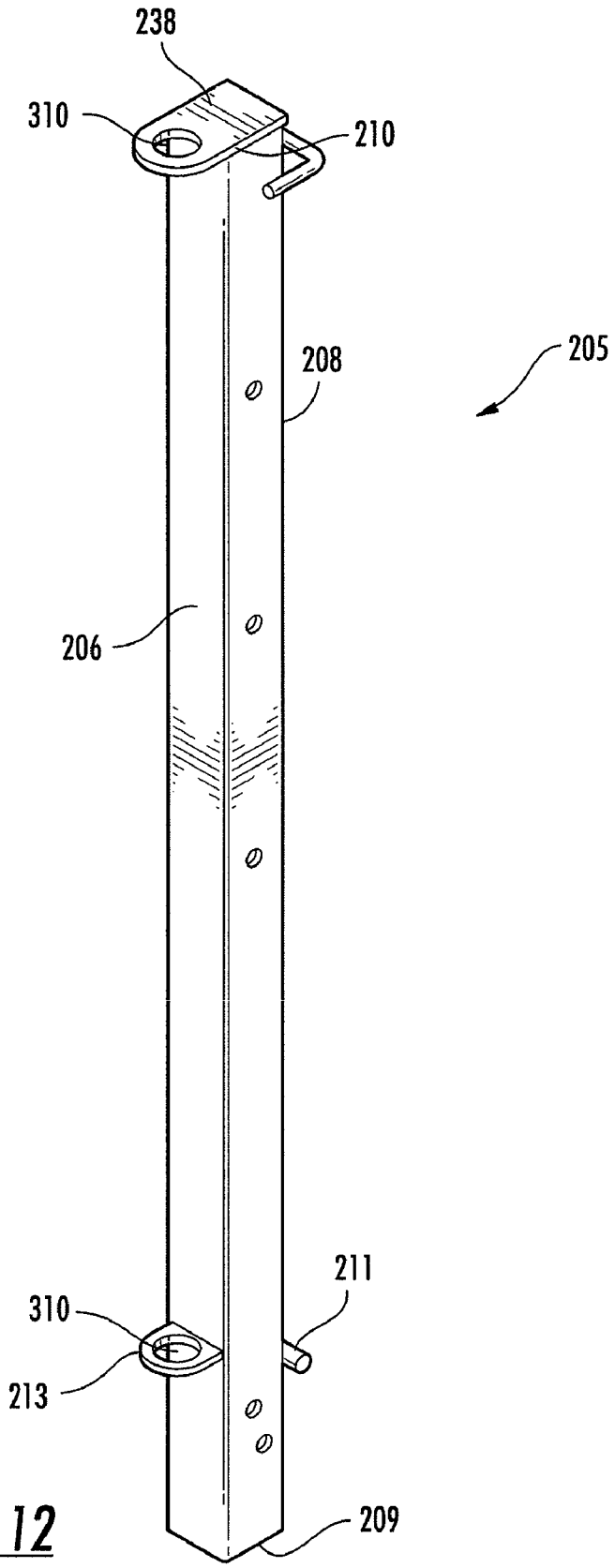
FIG. 12 is a perspective view of the upright support assembly and a lifting frame assembly of the vehicle jack of FIG. 10.

As may be understood from FIGS. 11, 12, and 15, in particular embodiments, an upper (e.g., a second) end 252 of the elongated support member 236 is adapted to pass through the first bracket's opening 310. In particular embodiments, as shown generally in FIG. 11, the upper end 252 may be adapted to be mounted adjacent (e.g., to) the handle 235 adjacent a top surface of the first bracket 238 using one or more fasteners (e.g., nuts, adhesive, clip, and/or other suitable fasteners). In particular embodiments, a lower (e.g., a first) end 251 of the elongated support member 236 passes through the second bracket's opening 310. In the embodiment shown in FIG. 11, the lower end 251 may be likewise adapted to be mounted adjacent (e.g. to) a bottom surface of the second bracket 213 using one or more fasteners (e.g., nuts, adhesive, clip, and/or other suitable fasteners). In this manner, according to various embodiments, the threaded elongated support member 236 (and, therefore, the elevation assembly 234) is attached adjacent (e.g., to) the upright support assembly 205. Further, in particular embodiments (see FIG. 11) a length of the threaded elongated support member 236 between the lower 251 and upper 252 ends of the threaded elongated support member 236 is spaced sufficiently apart from a front side 206 of the upright support assembly 205 to permit unobstructed movement of the guide assembly 228 along the length of the upright support assembly 205.

As may be understood from FIG. 11, the guide assembly 228, according to various embodiments of the invention, is attached adjacent (e.g., to) the elevation assembly 234. In particular embodiments of the invention, as illustrated in FIGS. 13 and 14, the guide bracket 244 of the guide assembly 228 operatively engages the threaded member 240 of the elevation assembly 234.

As may be understood from FIGS. 16A-D and 17A-C, in certain embodiments, the distance 281 between opposing interior back walls 286 of grooves 241 generally corresponds to the width 295 of the U-shaped channel 292, thereby permitting the threaded member 240 to matingly engage the U-shaped channel 292. In particular, the opposing and spaced apart side surfaces 296 of the U-shaped channel 292 matingly engage the opposing interior back walls 286 of the threaded member 240. Further, the interior top surfaces 284 and interior bottom surfaces 285 of the grooves 241 matingly engage the corresponding top and bottom surfaces of the horizontal portion 290 of the guide bracket 244. In addition, the arc defined by the interior front surface 298 of the U-shaped channel 292 corresponds with and matingly engages an arc defined by the exterior surface 283 disposed between the opposing grooves 241 of the threaded member 240.

As may be understood from FIGS. 16A-D and 17A-C, in particular embodiments, engagement of the interior back walls 286 of the threaded member grooves 241 with the opposing and spaced apart side surfaces 296 prevents rotation of the threaded member 240 relative to the guide bracket 244 even when the elongated support member 236 is rotated relative to the threaded member 240. In this manner, rotation of the threaded member 240 relative to the elongated support member 236 causes the threaded member 240 to move the guide bracket 244 (and, therefore, the guide assembly 228 and the lifting frame assembly 220) (see FIG. 11) along a length of the upright support assembly 205.

As may be understood from FIGS. 11 and 15, turning the handle 235 of the elevation assembly 234 (and, therefore, the elongated support member 236) in a take-up direction rotates the elongated support member 236, which in turn causes the threaded member 240 to travel upwardly along a length of the elongated support member 236. This causes the interior bottom surface 285 of the threaded member 240 to engage and move the guide bracket 244 (and, therefore, the guide assembly 228 and the lifting frame assembly 220) upwardly along the length of the upright support assembly 205. Similarly, turning the handle 235 in a take-down direction (which may be, for example, opposite to the take-up direction), causes the interior top surface 284 of the threaded member 240 to engage and move the guide bracket 244 (and, therefore, the guide assembly 228 and the lifting frame assembly 220) downwardly along the length of the upright support assembly 205.

As may also be understood from FIGS. 16A-D and 17A-C, in various embodiments, a length 300 of the rectangular-shaped channel 293 corresponds, at least approximately, to a distance 287 between the top exterior surface 288 of the threaded member 240 and the interior top surface 284 of the grooves 241. In particular embodiment, the top surface 288 of the threaded member 240 matingly engages the interior end surface 299 of the rectangular-shaped channel 293. In this embodiment, rotation of the threaded member 240 relative to the elongated support member 236 causes the top exterior surface 288 of the threaded member 240 to move the guide bracket 228 (and, therefore, the lifting frame assembly 220) along the length of the upright support assembly 205.

Operation of Various Embodiments of the Invention

Ratchet Driven Embodiment

In particular embodiments, to use the vehicle jack 1, a user first adjusts the vehicle jack 1 so that the vehicle jack's wheel support assemblies 24 are in at least substantial lateral alignment with the two front wheels of a vehicle (e.g., a riding lawn mower). The user then lowers the jack's lifting frame assembly 20 to a loading position in which the jack's wheel support assemblies 24 are disposed adjacent (e.g., on) a support surface (e.g., a support surface that is supporting the wheel jack 1). The user than moves the vehicle (e.g., a riding lawn mower) into a pre-lifting position in which each of the vehicle's front wheels is disposed on a respective one of the wheel support assemblies 24. In a particular embodiment, when the vehicle is in this position, each of the vehicle's front wheels is positioned so that the bottom portion of the wheel is disposed between two wheel support rollers 27 that are spaced apart within a respective one of the vehicle jack's wheel support assemblies 24.

Next, the user turns the handle of the brake winch 35 in a belt take-up direction, which causes the winch belt 36 to wind around the winch's take-up spool. This, in turn, causes the winch belt 36 to lift the vehicle jack's lifting frame assembly 20 to an elevated position in which the wheel support assemblies 24 are elevated (e.g., by at least 6 inches) above the support surface that is supporting the vehicle jack 1.

As the lifting frame assembly 20 is being moved from the loading position to the elevated position, the ratchet assembly 28 moves upwardly along a portion of the length of the upright support assembly 5. As this occurs, the ratchet assembly's first roller 43 rolls along the upright support assembly's front surface 8 and the ratchet assembly's second roller 44 rolls, between the respective toothed bars 13, along the upright support assembly's rear surface 6. During this process, the toothed bar engagement pin 19 engages the outer surface of a first rack tooth on each of the two toothed bars 13 (e.g., the lowest tooth on each of the toothed bars 13) and, as the ratchet assembly 28 moves upwardly adjacent these first rack teeth, the toothed bar engagement pin 19 moves (e.g., rolls) along the outer perimeters of the first rack teeth. During this process, the toothed bar engagement pin 19 is urged toward (and thereby maintained in contact with) the first rack teeth by the torsion spring 50. After the toothed bar engagement pin 19 passes the peak portion of the first rack teeth, the toothed bar engagement pin 19 moves into two offset, downwardly sloping troughs defined between the first rack teeth and the toothed rack assemblys' second rack teeth (e.g., the second lowest teeth on the toothed bars 13). When in this position, the torsion spring 50 maintains the toothed bar engagement pin 19 in place within the troughs, and the first rack teeth cooperate to prevent the toothed bar engagement pin 19 from moving downwardly past the first rack teeth. In various embodiments, this serves as a safety mechanism that would prevent the lifting frame assembly 20 from falling in the event that the brake associated with the winch mechanism 35 fails.

As the ratchet assembly 28 continues to move upwardly relative to the upright support assembly 5, the toothed bar engagement pin 19 continues to move relative to various other pairs of rack teeth as described above in regard to the first and second pairs of rack teeth. During the ratchet assembly's upward movement relative to the toothed rack assembly 12, the toothed bar engagement pin 19 intermittently snaps into place in the various downwardly sloping troughs between the rack's teeth.

When the vehicle's front wheels have been elevated sufficiently off the ground to allow the user to perform the desired maintenance on the vehicle, the user stops cranking the vehicle jack's winch crank in the belt take-up direction. As a result, the toothed bar engagement pin 19 settles into a particular pair of troughs defined between two particular pairs of rack teeth. As noted above, this provides an additional safety feature that would prevent the lifting frame assembly 20 from falling in the event that the brake on the winch assembly 34 fails.

When the user is ready to lower the vehicle (e.g., when the desired vehicle maintenance is complete) the user squeezes the release handle assembly 29 toward the jack handle assembly 31 which, in turn, moves the release handle assembly 29 upwardly toward the jack handle assembly 31. Due to the mechanical linking between the release handle assembly 29 and the jack's toothed bars 13 (see FIG. 5), the upward movement of the release handle assembly 29 causes the toothed bars 13 to, in turn, move upwardly. Due to the shape and angled orientation of the respective toothed bar pin slots 18 and the position of the toothed bar mounting pins 17 within the slots (see FIG. 2), as the toothed bars 13 move upwardly, they also move inwardly (or toward the front surface 8 of the upright support assembly 5), away from the toothed bar engagement pin 19, until none of the toothed rack assemblys' teeth are positioned vertically below the toothed bar engagement pin 19. Next, while continuing to squeeze the release handle assembly 29 toward the jack handle assembly 31, the user cranks the winch handle in the belt release direction. This causes the winch belt 36 to unwind off the brake winch's take-up spool that, in turn, lowers the lifting frame assembly 20. The user continues this process until the jack's lifting frame assembly 20 returns to a position in which the wheel jack's wheel support assemblies 24 are disposed adjacent (e.g., on) the support surface (e.g., a support surface that is supporting the wheel jack 1). The user may then roll the vehicle away from the vehicle jack 1.

Screw Driven Embodiment

In the alternative embodiment shown in FIGS. 10-17, the user turns the handle 235 of the elevation assembly 234 in a take-up direction, which causes the elongated support member 236 to rotate relative to the threaded member 240. Because the interior back surfaces 286 adjacent the threaded member's grooves 241 fix the threaded member 240 relative to the guide assembly 228, rotation of the elongated support member 236 in a take-up direction relative to the threaded member 240 causes the threaded member 240 to move upwardly along the length of the elongated support member 236. This upward travel of the threaded member 240, in turn, causes the interior bottom surfaces 285 adjacent the threaded member's grooves 241 to engage the guide bracket 244 of the guide assembly 228, thereby causing the guide assembly 228 (and, therefore, the lifting frame assembly 220) to likewise move upwardly along the length of the elongated support member 236. In this manner, in particular embodiments of the invention, turning the handle 235 in a take-up direction lifts the vehicle jack's lifting frame assembly 220 to an elevated position in which the wheel support assemblies 224 are elevated (e.g., by at least 6 inches) above the support surface that is supporting the vehicle jack 201.

As the lifting frame assembly 220 is being moved from the loading position to the elevated position, the guide assembly 228 moves upwardly along a portion of the length of the upright support assembly 205. As this occurs, the guide assembly's first roller 243 rolls along the upright support assembly's rear surface 209 and the guide assembly's second 246 and third 248 rollers slide along the upright support assembly's front surface 206. During this process, the opposing grooves 241 on the threaded member 240 engage opposing and spaced apart interior side surfaces 296 of the guide bracket's U-shaped channel 296. Additionally, during this process, the bottom surfaces 285 engages the horizontal portion 290 of the guide bracket 244, and the top exterior surface 288 of the threaded member 240 engages an interior end surface 299 of the guide bracket's rectangular-shaped channel 297. In this manner, in particular embodiments, the engagement of multiple surfaces of the threaded member 240 against multiple surfaces of the guide bracket 244 moves the lifting frame assembly 220 along a portion of the length of the upright support assembly 205.

When the vehicle's front wheels have been elevated sufficiently off of the ground to allow the user to perform the desired maintenance on the vehicle, the user stops turning the vehicle jack's handle 235 (and, therefore, the elevation assembly 234) in the take-up direction. As a result, the threaded member 240 settles into a self-locking position relative to the threads on the elongated support member 236. In addition, according to various embodiments, releasing the handle 235 ceases the rotational force upon the elongated support member 236, thereby selectively locking the interior back surfaces 286 of the threaded member's grooves 241 against the opposing and spaced apart interior side surfaces 296 of the guide bracket's U-shaped channel 296. When selectively locked, as such, the interior back surfaces 286 prevent inadvertent movement of the elongated support member 236 (and, therefore, the lifting frame assembly 220) until such time as the rotational force is reapplied by a user again turning the handle 235 (in either a take-up or take-down direction).

When the user is ready to lower the vehicle (e.g., when the desired vehicle maintenance is complete) the user turns the handle 235 of the elevation assembly 234 in a take-down direction (for example, in a direction opposite the take-up direction), which provides the necessary rotational force to cause the elongated support member 236 to rotate relative to the threaded member 240. This, in turn, causes the threaded member 240 to engage the guide bracket 244 of the guide assembly 228, which in turn lowers the vehicle jack's lifting frame assembly 220 relative to the elevated position in which the wheel support assemblies 224 were previously disposed.

Specifically, according to various embodiments, turning the handle 235 in the take-down direction causes the top surfaces 284 adjacent the threaded member's grooves 241 to engage the horizontal portion 290 of the guide bracket 244, which in turn lowers the lifting frame assembly 220. The user continues this process until the jack's lifting frame assembly 220 returns to the loading position in which the wheel jack's wheel support assemblies 224 are disposed adjacent (e.g., on) the support surface (e.g., a support surface that is supporting the wheel jack 201). The user may then roll the vehicle away from the vehicle jack 201.

Conclusion

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A vehicle jack comprising:

a base;

an upright support assembly having a first end and a second end, the first end mounted adjacent and extending upwardly from the base;

a guide assembly configured to move along a path defined by the upright support assembly;

a lifting frame assembly comprising:

a vehicle part engaging portion; and a connecting member configured to attach the lifting frame assembly to the guide assembly such that movement of the guide assembly along the path translates into movement of the lifting frame assembly along the path;

an elevation assembly comprising a threaded member and an elongated support member, the threaded member having at least two opposing grooves located adjacent an exterior surface of the threaded member, the elongated support member having a first end and a second end, the first and second ends mounted adjacent the respective first and second ends of the upright support assembly, the elongated support member being further configured to threadedly engage and rotate relative to the threaded member; and a guide bracket mounted adjacent the guide assembly, the guide bracket having at least two opposing surfaces configured to engage the at least two opposing grooves of the threaded member such that the threaded member moves with the guide assembly as the guide assembly moves along the path defined by the upright support assembly.

2. The vehicle jack of claim 1, wherein the upright support assembly extends substantially perpendicular to the base.

3. The vehicle jack of claim 1, wherein the guide assembly further comprises:

a first roller disposed adjacent a rear surface of the upright support assembly; and a second roller disposed adjacent a front surface of the upright support assembly, the first and second rollers cooperating to define a first channel configured to receive the upright support assembly therethrough.

4. The vehicle jack of claim 3, wherein the guide assembly further comprises a third roller, the third roller being disposed adjacent the front surface of the upright support assembly and further cooperating with the first roller to define the first channel the third roller further being spaced apart from the second roller and configured to cooperate therewith to define a second channel therebetween configured to receive the elongated support member therethrough.

5. The vehicle jack of claim 3, wherein the guide bracket is disposed adjacent the front surface of the upright support assembly and is further configured to cooperate with the first roller to define the first channel.

6. The vehicle jack of claim 1, wherein the at least one groove comprises at least two opposing grooves, each groove being configured to receive a portion of the guide assembly therein such that the threaded member is movable with the guide assembly along the path defined by the upright support assembly.

7. The vehicle jack of claim 6, wherein the guide bracket further includes at least two opposing portions configured to be received by the at least two opposing grooves defined by the threaded member so as to couple the threaded member to the guide assembly.

8. The vehicle jack of claim 1, further comprising a handle mounted to the second end of the elongated support member adjacent the second end of the upright support assembly, the handle being configured to cooperate with the elongated support member to rotate the elongated support member about a longitudinal axis defined thereby.

9. The vehicle jack of claim 1, wherein the vehicle jack comprises at least one wheel mounted adjacent the first end of the upright support assembly.

10. The vehicle jack of claim 1, wherein the vehicle part engaging portion further comprises:

a first wheel support assembly and an adjacent second wheel support assembly, each wheel support assembly, comprising:

a front support; and a rear support.

11. A vehicle jack comprising:

an upright support assembly having a first end and a second end;

an elevation assembly comprising a threaded member and an elongated support member, the threaded member having at least two opposing grooves located adjacent an exterior surface of the threaded member, the elongated support member being configured to threadably engage and rotate relative to the threaded member;

a guide assembly configured to move along a path defined by the upright support assembly, the guide assembly comprising a guide bracket, the guide bracket having at least two opposing surfaces configured to engage the at least two opposing grooves of the threaded member such that rotation of the elongated support member causes the threaded member to move the guide assembly along a path defined by a longitudinal axis of the elongated support member; and a lifting frame assembly connected to the guide assembly, the lifting frame comprising:

a wheel support assembly, comprising: a front support, and a rear support.

12. The vehicle jack of claim 11, wherein the wheel support assembly is adjustable on the lifting frame assembly for selectively poisoning each wheel support assembly under the vehicle.

13. The vehicle jack of claim 11, further comprising:

an automatic drive connected to the elongated support member for rotating the elongated support member.

14. A method for assembling a vehicle jack, the method comprising the steps of:

providing an upright support assembly having a first end and a second end;

providing a guide assembly configured to move along a path defined by the upright support assembly;

providing a vehicle part engaging portion attached to the guide assembly; providing an elevation assembly comprising a threaded member and an elongated support member, the threaded member having at least two opposing grooves located adjacent an exterior surface of the threaded member, the elongated support member having a first end and a second end, the first and second ends mounted adjacent the respective first and second ends of the upright support assembly defining a longitudinal axis;

engaging the threaded member with the elongated support member; and providing a guide bracket mounted adjacent the guide assembly, the guide bracket having at least two opposing surfaces configured to engage the at least two opposing grooves of the threaded member; and engaging with the at least two opposing surfaces of the guide bracket with the at least two opposing grooves of the threaded member, whereby rotation of the elongated support member about its longitudinal axis causes the threaded member to move the guide bracket along a path defined by the longitudinal axis.

15. The method of claim 14, further comprising the step of attaching a first and a second roller to the guide bracket such that the second roller is spaced apart from the first roller and the first and second roller cooperate to define a first channel configured to receive an upright support assembly therethrough.

16. The method of claim 15, further comprising the step of attaching a third roller to the guide bracket such that the third roller is spaced apart from the second roller and the second and third rollers cooperate to define a second channel therebetween configured to receive the elongated support member therethrough.

* * * * *